US011434111B2

(12) United States Patent
Kanda et al.

(10) Patent No.: US 11,434,111 B2
(45) Date of Patent: Sep. 6, 2022

(54) CRANE

(71) Applicant: TADANO LTD., Kagawa (JP)

(72) Inventors: Shinsuke Kanda, Kagawa (JP); Kazuma Mizuki, Kagawa (JP); Tatsuya Yanagisawa, Kagawa (JP); Tomokazu Goto, Kagawa (JP)

(73) Assignee: TADANO LTD., Kagawa (JP)

( * ) Notice: Subject to any disclaimer, the term of this patent is extended or adjusted under 35 U.S.C. 154(b) by 568 days.

(21) Appl. No.: 16/603,732

(22) PCT Filed: Jun. 13, 2018

(86) PCT No.: PCT/JP2018/022564
§ 371 (c)(1),
(2) Date: Oct. 8, 2019

(87) PCT Pub. No.: WO2018/230601
PCT Pub. Date: Dec. 20, 2018

(65) Prior Publication Data

US 2020/0031633 A1 Jan. 30, 2020

(30) Foreign Application Priority Data

Jun. 13, 2017 (JP) ..... JP2017-116181

(51) Int. Cl.
*B66C 13/00* (2006.01)
*B66C 13/22* (2006.01)
(Continued)

(52) U.S. Cl.
CPC ..... *B66C 13/22* (2013.01); *B66C 23/42* (2013.01); *B66C 13/48* (2013.01); *B66C 23/702* (2013.01); *B66C 2700/08* (2013.01); *B66D 1/44* (2013.01)

(58) Field of Classification Search
CPC ..... B66C 13/22; B66C 13/40; B66C 13/48; B66C 13/063; B66C 13/066; B66C 23/42; B66C 23/702
See application file for complete search history.

(56) References Cited

U.S. PATENT DOCUMENTS

2008/0275610 A1* 11/2008 Terashima ..... B66C 13/063 700/55
2013/0213919 A1 8/2013 Kyllingstad

FOREIGN PATENT DOCUMENTS

JP 2015-151211 A 8/2015
JP 2016-160081 A 9/2016
(Continued)

OTHER PUBLICATIONS

Feb. 16, 2021, European Search Report issued for related EP application No. 18817349.6.
(Continued)

*Primary Examiner* — Emmanuel M Marcelo
(74) *Attorney, Agent, or Firm* — Paratus Law Group, PLLC

(57) ABSTRACT

A crane calculates the resonance frequency of the fluctuation of a suspended load determined from the hanging length of a main wire rope or a sub wire rope, generates a control signal for actuators, in accordance with the operation of a turning operation tool, a hoisting operation tool and the like, and generates a filtering control signal for the actuators in which a frequency component in any frequency range has been attenuated from the control signal at any ratio in reference to the resonance frequency. When the actuators are controlled by the operation of the respective operation tool and when the actuators are controlled regardless of the operation of the respective operation tool, the frequency range to be attenuated and the attenuation ratio are switched to different settings.

12 Claims, 12 Drawing Sheets

(51) Int. Cl.

| | |
|---|---|
| ***B66C 23/42*** | (2006.01) |
| *B66C 13/48* | (2006.01) |
| *B66C 23/70* | (2006.01) |
| *B66D 1/44* | (2006.01) |

(56) References Cited

FOREIGN PATENT DOCUMENTS

| | | | | | |
|---|---|---|---|---|---|
| JP | WO2019168087 | A1 * | 2/2019 | ..... | B66C 13/18 |
| JP | 6648872 | B1 * | 2/2020 | ..... | B66C 13/063 |
| NO | 20100435 | A1 | 9/2011 | | |
| WO | WO 2005/012155 | A1 | 2/2005 | | |
| WO | WO-2019066016 | A1 * | 4/2019 | ..... | B66C 13/063 |
| WO | WO-2019168133 | A1 * | 9/2019 | ..... | B66C 13/063 |

OTHER PUBLICATIONS

Sep. 18, 2018, International Search Report issued for related PCT Application No. PCT/JP2018/022564.
Sep. 18, 2018, International Search Opinion issued for related PCT Application No. PCT/JP2018/022564.

* cited by examiner

CRANE

CROSS REFERENCE TO PRIOR APPLICATION

This application is a National Stage Patent Application of PCT International Patent Application No. PCT/JP2018/022564 (filed on Jun. 13, 2018) under 35 U.S.C. § 371, which claims priority to Japanese Patent Application No. 2017-116181 (filed on Jun. 13, 2017), which are all hereby incorporated by reference in their entirety.

TECHNICAL FIELD

The present invention relates to a crane. The present invention particularly relates to a crane that attenuates a resonance frequency component from a control signal.

BACKGROUND ART

Conventionally, a load under conveyance in a crane, as a simple pendulum which is a material point of the load suspended from a leading end of a wire rope or as a double pendulum whose fulcrum is a hook part, is vibrated by acceleration applied during conveyance and functioning as a vibratory force. Moreover, besides the vibration caused by the simple pendulum or the double pendulum, in a case where the load is conveyed by a crane provided with a telescopic boom, there is another vibration caused by deflection of each structural component constituting the crane, such as the telescopic boom, wire rope, or the like. The load suspended from the wire rope is conveyed while vibrating at the resonance frequency of the simple pendulum or the double pendulum and also vibrating at the natural frequencies of the telescopic boom in the luffing direction and/or in the swiveling direction, at the natural frequency of the wire rope during stretching vibration caused by stretch of the wire rope, and/or the like.

In such a crane, an operator needs to manipulate to cancel out the vibration of the load by swiveling or luffing the telescopic boom manually with a manipulation tool in order to stably lower the load to a predetermined position. For this reason, the conveyance efficiency of the crane is affected by the magnitude of the vibration caused during conveyance and by the skill level of a crane operator. In this respect, a crane is known in which the conveyance efficiency is enhanced by attenuating a frequency component of the resonance frequency of the load from a speed command (control signal) for an actuator of the crane so as to reduce the vibration of the load (see, e.g., Patent Literature (hereinafter, referred to as "PTL") 1).

A crane device described in PTL 1 is a crane device which moves while suspending a load from a wire rope hung down from a trolley. The crane device sets a time lag filter based on the resonance frequency of a pendulum computed from the suspended length of the wire rope. The crane device can reduce the vibration of the load by moving the trolley by a corrected trolley speed command which is a trolley speed command to which the time lag filter is applied. Meanwhile, the effect of the time lag filter causes a difference between the operational state of the crane based on the operational sense of the operator and the actual operational state of the crane, resulting in a reduction in manipulability of the crane. Accordingly, for an operator who switches on and off with a manipulation lever (manipulation tool) less times in the manual operation, the crane device determines his/her manipulative skill level to be high and decreases the vibration reduction rate of the time lag filter to set a narrower vibration attenuation frequency band so as to improve the manipulability. In addition, for an operator who switches on and off with the manipulation lever (manipulation tool) more times in the manual operation, the crane device determines his/her manipulative skill level to be low and increases the vibration reduction rate of the time lag filter to set a wider vibration attenuation frequency band so as to improve a vibration reducing effect.

However, the crane device described in PTL 1 determines the setting of the time lag filter solely based on the number of times of switching on and off of the manipulation lever, so that it is sometimes impossible to obtain the vibration reducing effect suitable for the operational state of the crane (that is, a greater number of times of switching on and off in precise manipulation which requires higher manipulability reduces the manipulability, or a smaller number of times of switching on and off for reason of rough operation reduces the vibration reducing effect).

CITATION LIST

Patent Literature

PTL 1
Japanese Patent Application Laid-Open No. 2015-151211

SUMMARY OF INVENTION

Technical Problem

An object of the present invention is to provide a crane which can obtain manipulability and a vibration reducing effect according to an operational state.

Solution to Problem

The technical problem to be solved by the present invention is as described above, and a solution to this problem will be described next.

That is, the crane controls an actuator by computing a resonance frequency of a shake of a load, generating a control signal for the actuator according to manipulation of a manipulation tool, and generating a filtered control signal for the actuator, the resonance frequency being determined by a suspended length of a wire rope, the filtered control signal being the control signal from which a frequency component in any frequency range is attenuated at any rate with reference to the resonance frequency, in which setting for at least the frequency range of the frequency component to be attenuated or the rate at which the frequency component is attenuated is switched between a case where the actuator is controlled by manipulation of the manipulation tool and a case where the actuator is controlled without the manipulation of the manipulation tool, the setting being different between the manual-control case and the automatic-control case.

The crane controls an actuator by computing a resultant frequency resulting from combination of a resonance frequency of a shake of a load and a natural vibration frequency excited when a structural component constituting the crane is vibrated by an external force, generating a control signal for the actuator according to manipulation of a manipulation tool, and generating a filtered control signal for the actuator, the resonance frequency being determined by a suspended length of a wire rope, the filtered control signal being the control signal from which a frequency component in any frequency range is attenuated at any rate with reference to the resultant frequency, in which setting for at least the frequency range of the frequency component to be attenuated or the rate at which the frequency component is attenuated is switched between a manual-control case and an automatic-control case, the manual-control case being where the actuator is controlled by manipulation of the manipulation tool, the automatic-control case being where the actuator is controlled without the manipulation of the manipulation tool, the setting being different between the manual-control case and the automatic-control case.

The crane is a crane in which at least the frequency range of the frequency component to be attenuated or the rate at which the frequency component is attenuated is set based on an operational state of the crane in the manual-control case where the actuator is controlled by the manipulation of the manipulation tool, and at least the frequency range of the frequency component to be attenuated or the rate at which the frequency component is attenuated is switched to a predetermined value in the automatic-control case where the actuator is controlled without manipulation of the manipulation tool.

The crane is a crane in which the setting for at least the frequency range of the frequency component to be attenuated or the rate at which the frequency component is attenuated is switched between a first manual-control case and a second manual-control case, the first manual-control case being where the actuator being a single actuator is controlled by the manipulation of the manipulation tool, the second manual-control case being where a plurality of the actuators are controlled by the manipulation of the manipulation tool, the setting being different between the first manual-control case and the second manual-control case.

The crane is a crane in which, when an emergency stop signal is generated by the manipulation of the manipulation tool, control for the actuator by the filtered control signal from which the frequency component in any frequency range is attenuated at any rate is switched into control by the control signal from which the frequency component is not attenuated The crane is a crane in which at least the frequency range of the frequency component to be attenuated or the rate at which the frequency component is attenuated is switched according to a position of the load in a working region of the crane.

The crane is a crane in which the frequency range of the frequency component to be attenuated and the rate at which the frequency component is attenuated are set according to a weight of the load.

Advantageous Effects of Invention

The present invention produces effects as described below.

A filtered control signal is generated in a crane with reference to a resonance frequency of a load conceived as a simple pendulum or with reference to a resultant frequency resulting from combination of the resonance frequency and the natural frequency of a boom, and the crane is controlled by the filtered control signal for prioritizing manipulability in a case where the crane is manually manipulated, or the crane is controlled by the filtered control signal for prioritizing a vibration reducing effect in a case where an automatic control is performed. It is thus possible to obtain the manipulability and vibration reducing effect according to the operational state.

The filtered control signal is generated in the crane in consideration of how easily a vibration is caused. It is thus possible to obtain the manipulability and vibration reducing effect according to the operational state.

In a case where additional manipulation of the manipulation tool may cause an abrupt acceleration of an actuator, the filtered control signal for prioritizing the vibration reducing effect for the additional manipulation is generated in the crane. It is thus possible to obtain the manipulability and vibration reducing effect according to the operational state.

In a case where it is necessary to stop the boom or the like immediately, the control signal is not corrected in order to prioritize the manipulability in the crane. It is thus possible to obtain the manipulability and vibration reducing effect according to the operational state.

The filtered control signal taking into consideration the situation of planimetric features and the operational state of the crane in a working region is generated in the crane. It is thus possible to obtain the manipulability and vibration reducing effect according to the operational state.

The filtered control signal is generated in the crane according to the state of a load. It is thus possible to obtain the manipulability and vibration reducing effect according to the operational state.

DESCRIPTION OF EMBODIMENTS

Hereinafter, a description will be given of crane 1 according to Embodiment 1 of the present invention with reference to FIGS. 1 and 2. Note that, although the present embodiment will be described in relation to a mobile crane (rough terrain crane) as crane 1, crane 1 may also be a truck crane or the like.

Figure 1:
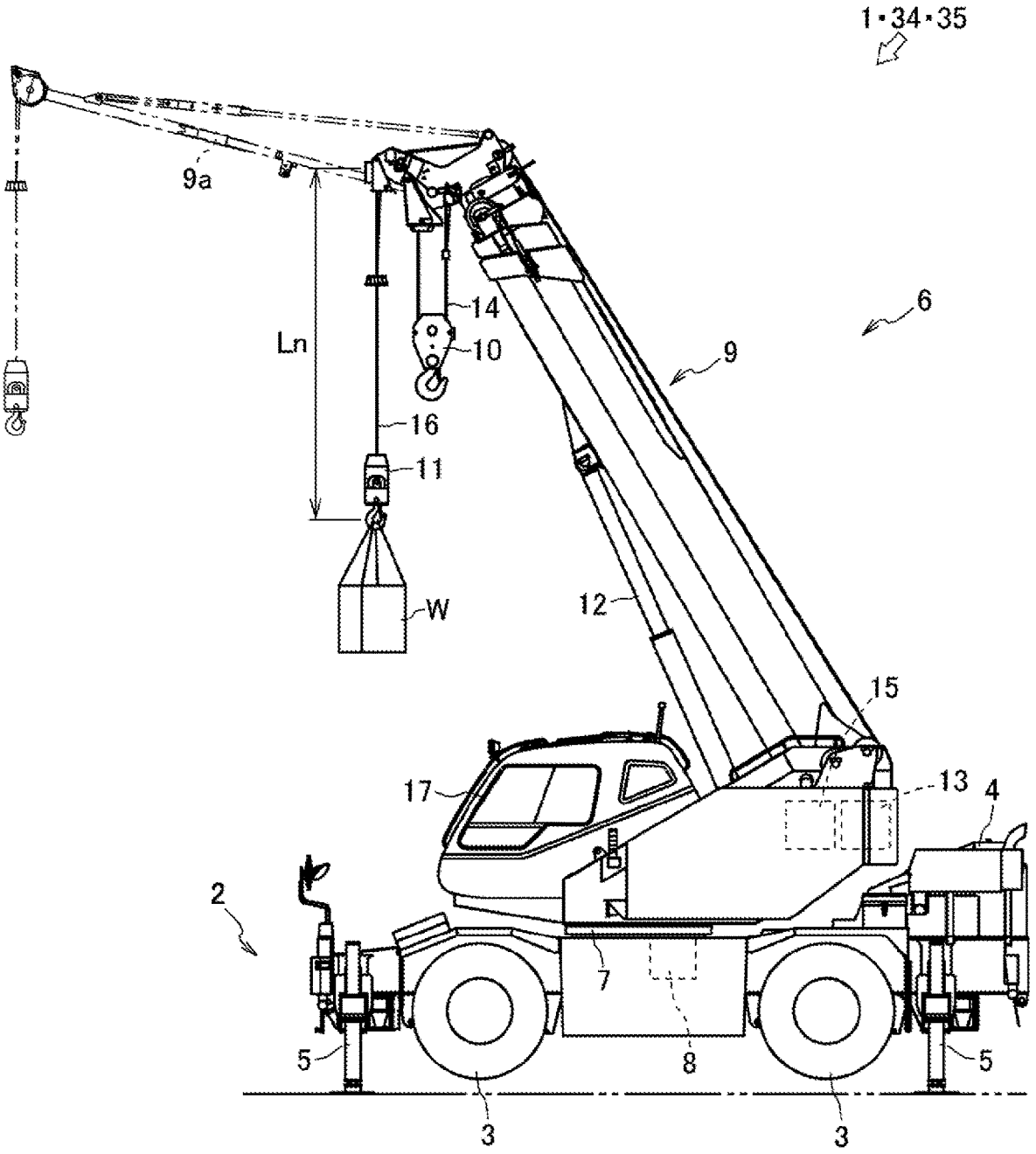
FIG. 1 is a side view illustrating an entire configuration of a crane.

As illustrated in FIG. 1, crane 1 is a mobile crane that can be moved to an unspecified place. Crane 1 includes vehicle 2 and crane device 6.

Vehicle 2 carries crane device 6. Vehicle 2 includes a plurality of wheels 3, and travels using engine 4 as a power source. Vehicle 2 is provided with outriggers 5. Outriggers 5 are composed of projecting beams hydraulically extendable on both sides of vehicle 2 in the width direction and hydraulic jack cylinders extendable in the direction vertical to the ground. Vehicle 2 can extend a workable region of crane 1 by extending outriggers 5 in the width direction of the vehicle 2 and bringing the jack cylinders into contact with the ground.

Crane device 6 hoists up load W with a wire rope. Crane device 6 includes swivel base 7, telescopic boom 9, jib 9*a*, main hook block 10, sub hook block 11, hydraulic luffing cylinder 12, main winch 13, main wire rope 14, sub winch 15, sub wire rope 16, cabin 17, and the like.

Swivel base 7 allows crane device 6 to swivel. Swivel base 7 is disposed on a frame of vehicle 2 via an annular bearing. Swivel base 7 is configured to be rotatable around the center of the annular bearing serving as a rotational center. Swivel base 7 is provided with hydraulic swivel motor 8 that is an actuator. Swivel base 7 is configured to swivel in one and the other directions by hydraulic swivel motor 8.

Figure 2:
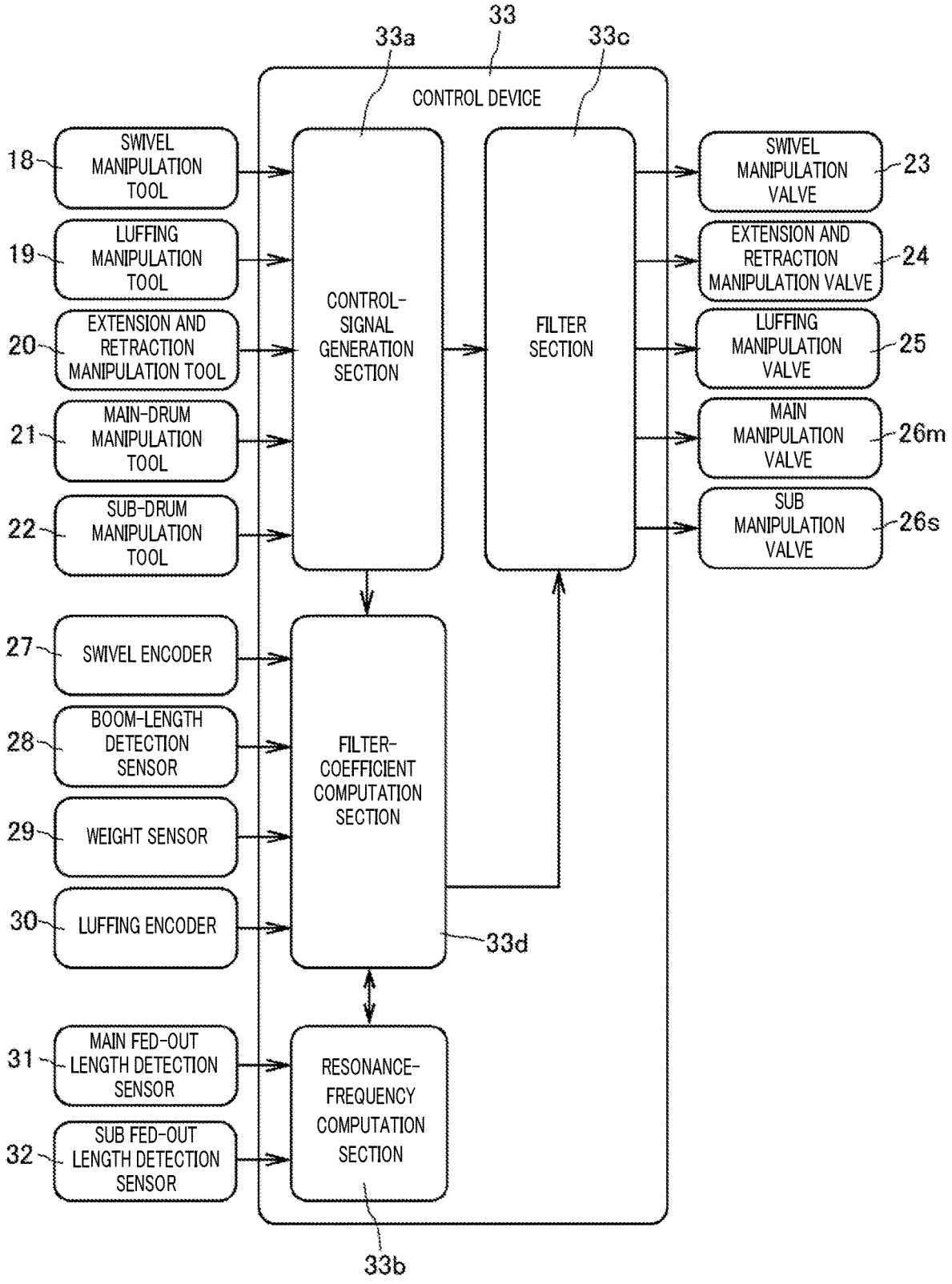
FIG. 2 is a block diagram illustrating a control configuration of the crane.

Hydraulic swivel motor 8 as the actuator is manipulated to rotate by swivel manipulation valve 23 that is an electromagnetic proportional switching valve (see FIG. 2). Swivel manipulation valve 23 can control the flow rate of the operating oil supplied to hydraulic swivel motor 8 such that the flow rate is any flow rate. That is, swivel base 7 is configured to be controllable via hydraulic swivel motor 8 manipulated to rotate by swivel manipulation valve 23 such that the swivel speed of swivel base 7 is any swivel speed. Swivel base 7 is provided with swivel encoder 27 (see FIG. 2) that detects the swivel position (angle) and swivel speed of swivel base 7.

Telescopic boom 9 supports the wire rope such that load W can be hoisted. Telescopic boom 9 is composed of a plurality of boom members. Telescopic boom 9 is configured to be extendible and retractable in the axial direction by moving the boom members by a hydraulic extension and retraction cylinder (not illustrated) that is an actuator. Telescopic boom 9 is disposed such that the base end of a base boom member can be swung at a substantial center of swivel base 7.

The hydraulic extension and retraction cylinder (not illustrated) as the actuator is manipulated to extend and retract by extension and retraction manipulation valve 24 that is an electromagnetic proportional switching valve (see FIG. 2). Extension and retraction manipulation valve 24 can control the flow rate of the operating oil supplied to the hydraulic extension and retraction cylinder such that the flow rate is any flow rate. That is, telescopic boom 9 is configured to be controllable by extension and retraction manipulation valve 24 such that telescopic boom 9 has any boom length. Telescopic boom 9 is provided with boom-length detection sensor 28 that detects the length of telescopic boom 9 and weight sensor 29 (see FIG. 2) that detects weight Wt of load W.

Jib 9*a* extends the lifting height and the operating radius of crane device 6. Jib 9*a* is held by a jib supporting part disposed in the base boom member of telescopic boom 9 such that the attitude of jib 9*a* is along the base boom member. The base end of jib 9*a* is configured to be able to be coupled to a jib supporting part of a top boom member.

Main hook block 10 and sub hook block 11 are for hanging load W. Main hook block 10 is provided with a plurality of hook sheaves around which main wire rope 14 is wound, and a main hook for hanging the load W. Sub hook block 11 is provided with a sub hook for hanging load W.

Hydraulic luffing cylinder 12 as an actuator luffs up or down telescopic boom 9, and holds the attitude of telescopic boom 9. Hydraulic luffing cylinder 12 is composed of a cylinder part and a rod part. In hydraulic luffing cylinder 12, an end of the cylinder part is swingably coupled to swivel base 7, and an end of the rod part is swingably coupled to the base boom member of telescopic boom 9.

Hydraulic luffing cylinder 12 is manipulated to extend or retract by luffing manipulation valve 25 (see FIG. 2) that is an electromagnetic proportional switching valve. Luffing manipulation valve 25 can control the flow rate of the operating oil supplied to hydraulic luffing cylinder 12 such that the flow rate is any flow rate. That is, telescopic boom 9 is configured to be controllable by luffing manipulation valve 25 such that telescopic boom 9 is luffed at any luffing speed. Telescopic boom 9 is provided with luffing encoder 30 (see FIG. 2) that detects the luffing angle of telescopic boom 9.

Main winch 13 and sub winch 15 wind up (reel up) and feed out (release) main wire rope 14 and sub wire rope 16, respectively. Main winch 13 has a configuration in which a main drum around which main wire rope 14 is wound is rotated by a main hydraulic motor (not illustrated) that is an actuator, and sub winch 15 has a configuration in which a sub drum around which sub wire rope 16 is wound is rotated by a sub hydraulic motor (not illustrated) that is an actuator.

The main hydraulic motor is manipulated to rotate by main manipulation valve 26*m* (see FIG. 2) that is an electromagnetic proportional switching valve. Main manipulation valve 26*m* can control the flow rate of the operating oil supplied to the main hydraulic motor such that the flow rate is any flow rate. That is, main winch 13 is configured to be controllable by main manipulation valve 26*m* such that the winding-up and feeding-out rate is any rate. Similarly, sub winch 15 is configured to be controllable by sub manipulation valve 26*s* (see FIG. 2) that is an electromagnetic proportional switching valve such that the winding-up and feeding-out rate is any rate. Main winch 13 is provided with main fed-out length detection sensor 31. Similarly, sub winch 15 is provided with sub fed-out length detection sensor 32.

Cabin 17 covers an operator compartment. Cabin 17 is mounted on swivel base 7. Cabin 17 is provided with an operator compartment which is not illustrated. The operator compartment is provided with manipulation tools for traveling manipulation of vehicle 2, swivel manipulation tool 18, luffing manipulation tool 19, extension and retraction manipulation tool 20, main-drum manipulation tool 21, sub-drum manipulation tool 22, and the like for manipulating crane device 6 (see FIG. 2). Swivel manipulation tool 18 can control hydraulic swivel motor 8 by manipulating swivel manipulation valve 23. Luffing manipulation tool 19 can control hydraulic luffing cylinder 12 by manipulating luffing manipulation valve 25. Extension and retraction manipulation tool 20 can control the hydraulic extension and retraction cylinder by manipulating extension and retraction manipulation valve 24. Main-drum manipulation tool 21 can control the main hydraulic motor by manipulating main manipulation valve 26*m*. Sub-drum manipulation tool 22 can control the sub hydraulic motor by manipulating sub manipulation valve 26*s*.

With crane 1 configured as described above, it is possible to move crane device 6 to any position by causing vehicle 2 to travel. It is also possible in crane 1 to extend the lifting height and/or the operating radius of crane device 6 by luffing up telescopic boom 9 to any luffing angle with hydraulic luffing cylinder 12 by manipulation of luffing manipulation tool 19, extending telescopic boom 9 to any length of telescopic boom 8 by manipulation of extension and retraction tool 20, and/or the like. It is also possible in crane 1 to convey load W by hoisting up load W with sub-drum manipulation tool 22 and/or the like, and causing swivel base 7 to swivel by manipulation of swivel manipulation tool 18.

Control device 33 controls the actuators of crane 1 via the manipulation valves as illustrated in FIG. 2. Control device 33 includes control-signal generation section 33*a*, resonance-frequency computation section 33*b*, filter section 33*c*, and filter-coefficient computation section 33*d*. Control device 33 is provided inside cabin 17. Substantively, control device 33 may have a configuration in which a CPU, ROM, RAM, HDD, and/or the like are connected to one another via a bus, or may be configured to consist of a one-chip LSI or the like. Control device 33 stores therein various programs and/or data in order to control the operation of control-signal generation section 33*a*, resonance-frequency computation section 33*b*, filter section 33*c*, and filter-coefficient computation section 33*d*.

Control-signal generation section 33*a* is a part of control device 33, and generates a control signal that is a speed command for each of the actuators. Control-signal generation section 33*a* is configured to obtain the manipulation amount of each of swivel manipulation tool 18, luffing manipulation tool 19, extension and retraction manipulation tool 20, main-drum manipulation tool 21, sub-drum manipulation tool 22, and the like, and generate control signal C(1) for swivel manipulation tool 18, control signal C(2) for luffing manipulation tool 19, . . . , and/or control signal C(n) (hereinafter, the control signals are simply collectively referred to as "control signal C(n)," where "n" denotes any number). Control-signal generation section 33*a* is also configured to generate control signal C(na) for performing an automatic control (e.g., automatic stop, automatic conveyance, or the like) without manipulation of any of the manipulation tools (without manual control) when telescopic boom 9 approaches a restriction area of the working region and/or when control-signal generation section 33*a* obtains a specific command, or control signal C(ne) for performing an emergency stop control based on emergency stop manipulation of any of the manipulation tools.

Resonance-frequency computation section 33*b* is a part of control device 33, and computes resonance frequency ω(n) of a shake of load W suspended from main wire rope 14 or sub wire rope 16 and serving as a simple pendulum. Resonance-frequency computation section 33*b* obtains the luffing angle of telescopic boom 9 obtained by filter-coefficient computation section 33*d*, the fed-out amount of main wire rope 14 or sub wire rope 16 from main fed-out length detection sensor 31 or sub fed-out length detection sensor 32, and the number of parts of line of main hook block 10 from a safety device (not illustrated) in the case of using main hook block 10.

Further, resonance-frequency computation section 33*b* is configured to compute suspended length Lm(n) of main wire rope 14 from a position of a sheave at which main wire rope 14 leaves the sheave to main hook block 10 or the suspended length Ls(n) of sub wire rope 16 from a position of a sheave at which sub wire rope 16 leaves the sheave to sub hook block 11 (see FIG. 1) based on the obtained luffing angle of telescopic boom 9, the fed-out amount of main wire rope 14 or sub wire rope 16, and the number of parts of line of main hook block 10 in the case of using main hook block 10, and compute resonance frequency $\omega(n)=\sqrt{(g/L(n))}$ (Equation 1) based on gravitational acceleration g and suspended length Lm(n) or suspended length Ls(n) (L(n) in Equation 1 denotes suspended length Lm(n) or suspended length Ls(n)).

Filter section 33*c* is a part of control device 33, and generates notch filters F(1), F(2), . . . , and/or F(n) for attenuating specific frequency regions of control signals C(1), C(2), . . . , and/or C(n) (hereinafter, such notch filters are collectively referred to as "notch filter F(n)" where n is any number) and applies notch filter F(n) to control signal C(n). Filter section 33*c* is configured to obtain control signals C(1), C(2), . . . , and/or C(n) from control-signal generation section 33*a*, apply notch filter F(1) to control signal C(1) to generate filtered control signal Cd(1) that is control signal C(1) from which frequency components of any frequency range are attenuated with reference to resonance frequency ω(1) at any rate, apply notch filter F(2) to control signal C(2) to generate filtered control signal Cd(2), . . . and/or apply notch filter F(n) to control signal C(n) to generate filtered control signal Cd(n) that is control signal C(n) from which frequency components of any frequency range are attenuated with reference to resonance frequency ω(n) at any rate (hereinafter, such filtered control signals are collectively referred to as "filtered control signal Cd(n) where n is any number").

Filter section 33*c* is configured to transmit filtered control signal Cd(n) to a corresponding manipulation valve among swivel manipulation valve 23, extension and retraction manipulation valve 24, luffing manipulation valve 25, main manipulation valve 26*m*, and sub manipulation valve 26*s*. That is, control device 33 is configured to be able to control hydraulic swivel motor 8, hydraulic luffing cylinder 12, the main hydraulic motor (not illustrated), and the sub hydraulic motor (not illustrated) that are the actuators via the respective manipulation valves.

Filter-coefficient computation section 33*d* is a part of control device 33, and computes, based on the operational state of crane 1, center frequency coefficient $\omega_n$, notch width coefficient ζ, and notch depth coefficient δ of transfer function H(s) that notch filter F(n) has (see Equation 2). Filter-coefficient computation section 33*d* is configured to compute notch width coefficient ζ and notch depth coefficient δ corresponding to each control signal C(n), and compute corresponding center frequency coefficient $\omega_n$ with the obtained resonance frequency ω(n) being used as center frequency ωc(n).

Notch filter F(n) will be described with reference to FIGS. 3 and 4. Notch filter F(n) is a filter with any center frequency for giving steep attenuation to control signal C(n).

Figure 3:
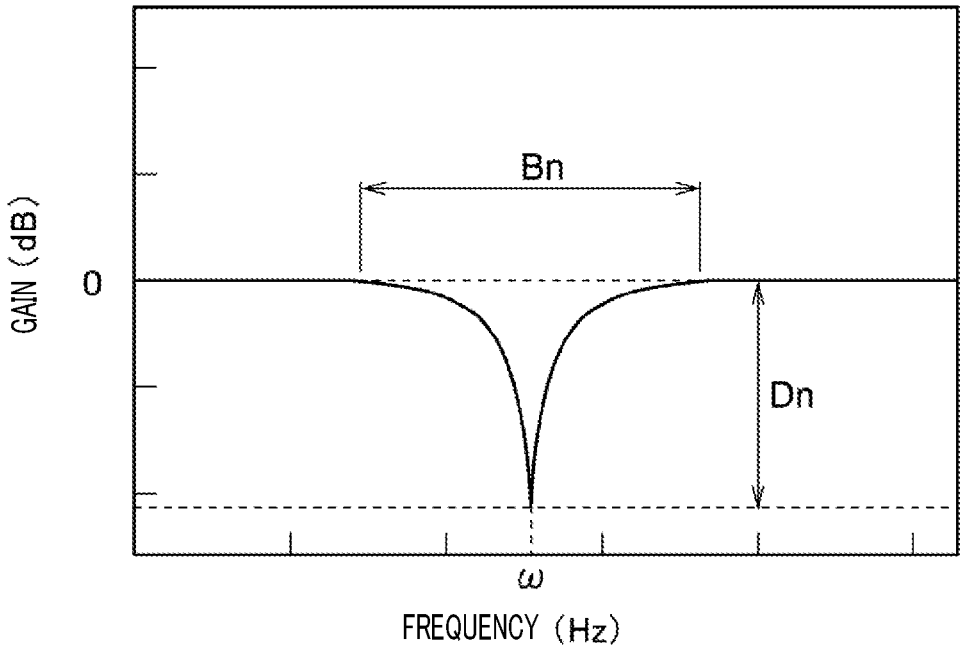
FIG. 3 illustrates a graph indicating frequency characteristics of a notch filter.

As illustrated in FIG. 3, notch filter F(n) is a filter having frequency characteristics by which the frequency components in notch width Bn that is any frequency range centrally including any center frequency ωc(n) are attenuated at notch depth Dn that is an attenuation rate of any frequency at center frequency ωc(n). That is, the frequency characteristics of notch filter F(n) are set by center frequency ωc(n), notch width Bn, and notch depth Dn.

Notch filter F(n) includes transfer function H(s) indicated by following Equation 2.

[1]

(Equation 2)

$$H(s) = \frac{s^2 + 2\delta\zeta\omega_n s + \omega_n^2}{s^2 + 2\zeta\omega_n s + \omega_n^2} \quad (2)$$

In Equation 2, "$\omega_n$" denotes center frequency coefficient $\omega_n$ corresponding to center frequency ωc(n) of notch filter F(n), "ζ" denotes notch width coefficient ζ corresponding to notch width Bn, and "δ" denotes notch depth coefficient δ corresponding to notch depth Dn. In notch filter F(n), changing center frequency coefficient $\omega_n$ changes center frequency ωc(n) of notch filter F(n), changing notch width coefficient ζ changes notch width Bn of notch filter F(n), and changing notch depth coefficient δ changes notch depth Dn of notch filter F(n).

The greater the notch width coefficient ζ is set, the greater the notch width Bn is set. Accordingly, in an input signal to which notch filter F(n) is applied, the attenuated frequency range from center frequency ωc(n) is set by notch width coefficient ζ.

Notch depth coefficient δ set is from 0 to 1.

Figure 4:
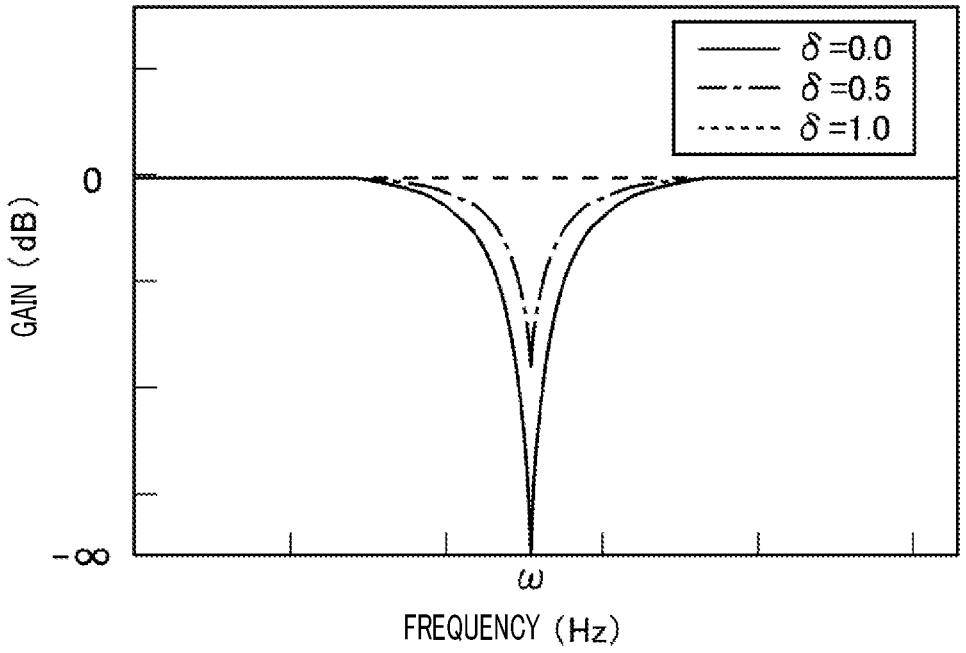
FIG. 4 illustrates a graph indicating the frequency characteristics of the notch filter in cases of different notch depth coefficients.

As illustrated in FIG. 4, notch filter F(n) achieves a gain characteristic of −∞ dB at center frequency ωc(n) in the case of notch depth coefficient δ=0. Notch filter F(n) thus achieves the greatest attenuation at center frequency ωc(n) in the input signal to which notch filter F(n) is applied. That is, notch filter F(n) outputs the input signal while maximizing the attenuation in the input signal in accordance with the frequency characteristics of notch filter F(n).

Notch filter F(n) achieves a gain characteristic of 0 dB at center frequency ωc(n) in the case of notch depth coefficient δ=1. Notch filter F(n) thus does not attenuate any frequency component of the input signal to which notch filter F(n) is applied. That is, notch filter F(n) outputs the input signal as input.

As illustrated in FIG. 2, control-signal generation section 33*a* of control device 33 is connected to swivel manipulation tool 18, luffing manipulation tool 19, extension and retraction manipulation tool 20, main-drum manipulation tool 21, and sub-drum manipulation tool 22, and can obtain the manipulation amount of each of swivel manipulation tool 18, luffing manipulation tool 19, main-drum manipulation tool 21, and sub-drum manipulation tool 22.

Resonance-frequency computation section 33*b* of control device 33 is connected to main fed-out length detection sensor 31, sub fed-out length detection sensor 32, filter-coefficient computation section 33*d*, and the safety device which is not illustrated, and can compute suspended length Lm(n) of main wire rope 14 or suspended length Ls(n) of sub wire rope 16.

Filter section 33*c* of control device 33 is connected to swivel manipulation valve 23, extension and retraction manipulation valve 24, luffing manipulation valve 25, main manipulation valve 26*m*, and sub manipulation valve 26*s*, and can transmit filtered control signal Cd(n) corresponding to each of swivel manipulation valve 23, luffing manipulation valve 25, main manipulation valve 26*m*, and sub manipulation valve 26*s*. Filter section 33*c* is also connected to control-signal generation section 33*a*, and can obtain control signal C(n). Filter section 33*c* is also connected to filter-coefficient computation section 33*d*, and can obtain notch width coefficient ζ, notch depth coefficient δ, and center frequency coefficient $\omega_n$.

Filter-coefficient computation section 33*d* of control device 33 is connected to swivel encoder 27, boom-length detection sensor 28, weight sensor 29, and luffing encoder 30, and can obtain the swivel position of swivel base 7, the boom length, and the luffing angle, and weight Wt of load W. Filter-coefficient computation section 33*d* is also connected to control-signal generation section 33*a*, and can obtain control signal C(n). Filter-coefficient computation section 33*d* is also connected to resonance-frequency computation section 33*b*, and can obtain suspended length Lm(n) of main wire rope 14, suspended length Ls(n) of sub wire rope 16 (see FIG. 1), and resonance frequency ω(n).

Control device 33 generates, at control-signal generation section 33*a*, control signal C(n) corresponding to each of swivel manipulation tool 18, luffing manipulation tool 19, main-drum manipulation tool 21, and sub-drum manipulation tool 22 based on the manipulation amount of the manipulation tool. Control device 33 also computes resonance frequency ω(n) at resonance-frequency computation section 33*b*. Moreover, control device 33 computes, at filter-coefficient computation section 33*d*, notch width coefficient ζ and notch depth coefficient δ corresponding to control signal C(n) from control signal C(n), the swivel position of swivel base 7, the boom length and luffing angle of telescopic boom 9, and weight Wt of load W, and computes corresponding center frequency coefficient $\omega_n$ while using resonance frequency ω(n) computed at resonance-frequency computation section 33*b* as referential center frequency ωc(n) of notch filter F(n).

Figure 5:
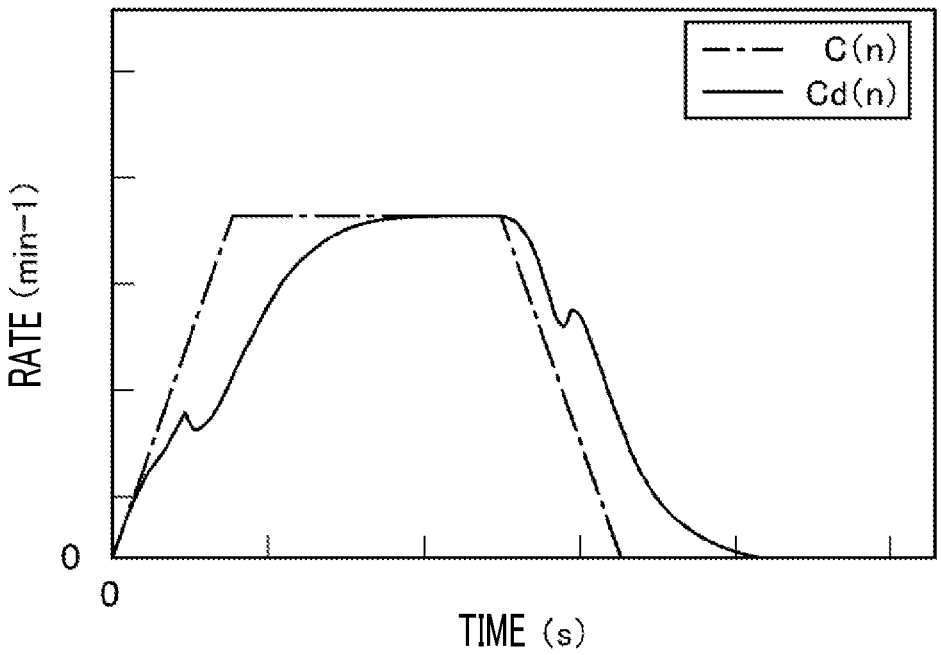
FIG. 5 illustrates a graph indicating a control signal for swivel manipulation and a filtered control signal to which the notch filter is applied.

As illustrated in FIG. 5, control device 33 generates filtered control signal Cd(n) at filter section 33*c* by applying, to control signal C(n), notch filter F(n) in which notch width coefficient ζ, notch depth coefficient δ, and center frequency coefficient $\omega_n$ are applied. Since the frequency component of resonance frequency ω(n) is attenuated in filtered control signal Cd(n) to which notch filter F(n) is applied, filtered control signal Cd(n) exhibits a slower rise than control signal C(n) does and the time taken for a movement to be finished is greater in the case of filtered control signal Cd(n) than in the case control signal C(n).

Specifically, in any of the actuators controlled by filtered control signal Cd(n) to which notch filter F(n) with notch depth coefficient δ close to 0 (notch depth Dn is deep) is applied, the reaction of the movement by the manipulation of the manipulation tool is slower and the manipulability is lower than in a case where the actuator is controlled by filtered control signal Cd(n) to which notch filter F(n) with notch depth coefficient δ close to 1 (notch depth Dn is shallow) is applied, or in a case where the actuator is controlled by control signal C(n) to which notch filter F(n) is not applied.

Likewise, in any of the actuators controlled by filtered control signal Cd(n) to which notch filter F(n) with notch width coefficient ζ being relatively greater than a normal value (notch width Bn is relatively great) is applied, the reaction of the movement by the manipulation of the manipulation tool is slower and the manipulability is lower than in a case where the actuator is controlled by filtered control signal Cd(n) to which notch filter F(n) with notch width coefficient ζ being relatively smaller than the normal value (notch width Bn is relatively narrow) is applied, or in a case where the actuator is controlled by control signal C(n) to which notch filter F(n) is not applied.

Next, a description will be given of a vibration control of control device 33 based on the operational state of crane 1. In the present embodiment, control device 33 sets at least notch depth coefficient δ or notch width coefficient ζ of notch filter F(n) according to the operational state of crane 1, and/or the ability and/or preferences of an operator. Although, as for notch filter F(n), notch depth coefficient δ is set to any value according to the operational state of crane 1 and/or the like and notch width coefficient ζ is set to a predetermined fixed value in the following embodiment, notch width coefficient ζ may also be changed to any value according to the operational state of crane 1 and/or the like. Moreover, the description will be given on the supposition that control device 33 computes center frequency coefficient $\omega_n$ while using, as referential center frequency ωc(n) of notch filter F(n), only resonance frequency ω(n) computed at resonance-frequency computation section 33*b*. Control device 33 is supposed to generate, at control-signal generation section 33*a* at every scan time, control signal C(n) that is a speed command for any of swivel manipulation tool 18, luffing manipulation tool 19, main-drum manipulation tool 21, and sub-drum manipulation tool 22 based on the manipulation amount of the manipulation tool.

When crane 1 is operated manually by manipulation of any of swivel manipulation tool 18, luffing manipulation tool 19, extension and retraction manipulation tool 20, main-drum manipulation tool 21, and sub-drum manipulation tool 22 (hereinafter, such a manipulation tool is simply referred to as "manipulation tool") in the vibration control, control device 33 sets notch filter F(n) with notch depth coefficient δ which is any predetermined value after obtaining control signal C(n) generated based on one manipulation tool from control-signal generation section 33*a*.

For example, in the case of an automatic control in which it is desired to prioritize the vibration reducing effect, control device 33 sets notch depth coefficient δ of a value close to 0 (e.g., notch depth coefficient δ=0.3) and applies, to control signal C(n), notch filter F(n) for greatly attenuating frequency components centrally including resonance frequency ω(n). Crane 1 can thus enhance the vibration reducing effect at resonance frequency ω(n) of load W. On the other hand, in the case of a manual control in which it is desired to prioritize the manipulability of the manipulation tool, control device 33 sets notch depth coefficient δ of a value close to 1 (e.g., notch depth coefficient δ=0.7), and applies, to control signal C(n), notch filter F(n) for which the attenuation rate of the frequency components centrally including resonance frequency ω(n) is reduced. Thus, crane 1 prioritizes keeping the manipulability of the manipulation tool over the vibration reducing effect at resonance frequency ω(n) of load W. That is, crane 1 can generate filtered control signal Cd(n) by notch filter F(n) with the frequency characteristics according to the ability and/or preferences of the operator.

In addition, in the case of a manual control in which one manipulation tool is being solely manipulated and another manipulation tool is further manipulated, and, when control device 33 obtains, from control signal generation section 33*a*, control signal C(n+1) generated based on the manipulation of the other manipulation tool after obtaining control signal C(n) generated based on the manipulation of the one manipulation tool, control device 33 switches notch filter F(n1) with notch depth coefficient δc1 to notch filter F(n2) with notch depth coefficient δc2 which is to be applied when a plurality of manipulation tools are manipulated. Further, control device 33 switches from notch filter F(n2) to notch filter F(n1) when there is a change from the manipulation of a plurality of manipulation tools to the manipulation of a single manipulation tool.

For example, in manipulation with a remote manipulation device or the like, it is possible that, when the manipulation amount of the one manipulation tool is applied as the manipulation amount of the other manipulation tool, a variation amount per unit time (acceleration) of control signal C(n+1) of the other manipulation tool may become significantly greater. Specifically, in a case where an ON/OFF switch of the swivel operation, an ON/OFF switch of the luffing manipulation, and a common speed lever for setting the speed of each manipulation are provided, and when the ON/OFF switch of the swivel manipulation is turned on and the luffing switch is turned on during swivel manipulation at any speed, the speed setting for the swivel operation is applied as the luffing manipulation. That is, it is possible that a large vibration may arise when manipulation is started with a plurality of manipulation tools.

In the case of the manual control in which the one manipulation tool is solely manipulated, control device 33 generates filtered control signal Cd(n1) by applying notch filter F(n1) with notch depth coefficient δc1 of a value close to 1 (e.g., notch depth coefficient δc2=0.7) to control signal C(n) according to the one manipulation tool in order to prioritize the manipulability of the manipulation tool. In the case of the manual control in which another manipulation tool is further manipulated, control device 33 generates filtered control signal Cd(n2) and filtered control signal Cd(n2+1) by applying notch filter F(n2) with notch depth coefficient δc2 of a value close to 0 (e.g., notch depth coefficient δc2=0.0) to control signal C(n) according to the one manipulation tool and control signal C(n+1) according to the other manipulation tool in order to prioritize the vibration reducing effect.

Further, in the case where there is the change from the manipulation with a plurality of (the one and the other) manipulation tools into the sole manipulation with the one manipulation tool, control device 33 switches from notch filter F(n2) to notch filter F(n1) and applies notch filter F(n1) to control signal C(n) according to the one manipulation tool so as to generate filtered control signal Cd(n1) in order to prioritize the manipulability of the manipulation tool. In addition, in a case where manipulation to stop the actuators by the one manipulation tool and the other manipulation tool is carried out, control device 33 applies notch filter F(n2) to control signal C(n) according to the one manipulation tool and to control signal C(n+1) according to the other manipulation tool so as to generate filtered control signal Cd(n2) and filtered control signal Cd(n2+1) in order to prioritize the vibration reducing effect.

Crane 1 can thus apply notch filter F(n1) in the case of sole manipulation of the one manipulation tool to generate filtered control signal Cd(n1) for prioritizing keeping the manipulability of the manipulation tool. In the case of manipulation to use a plurality of manipulation tools in combination by which a vibration is easily caused, crane 1 also can generate filtered control signal Cd(n2) and filtered control signal Cd(n2+1) for prioritizing the vibration reducing effect for the manipulation tools by applying notch filter F(n2).

In addition, in a case where crane 1 is operated by the automatic control, such as automatic stop before reaching a movement restriction area, automatic conveyance, or the like, and when filter-coefficient computation section 33*d* obtains control signal C(na) which is not based on manipulation of any of the manipulation tools from control-signal generation section 33*a*, control device 33 applies, to control signal C(na), notch filter F(n2) with notch depth coefficient δc2=0.0 which is a separately predetermined value, so as to generate filtered control signal Cd(na2).

For example, in a case where a limitation by restriction on a working region and/or a stop position are set and a load enters such a working region, crane 1 operates based on control signal C(na) of the automatic control without manipulation of any of the manipulation tools. Also in a case where an automatic conveyance mode is set for crane 1, crane 1 operates based on control signal C(na) of the automatic control for conveying predetermined load W from the load hoisting position to the load lowering position at a predetermined conveyance speed and at a predetermined conveyance height. That is, since crane 1 is manipulated not by an operator but by the automatic control, it is unnecessary to prioritize the manipulability of the manipulation tool. Accordingly, control device 33 applies notch filter F(n2) with notch depth coefficient δc2 of a value close to 0 (e.g., notch depth coefficient δc2=0.0) to control signal C(na) so as to generate filtered control signal Cd(na2) in order to prioritize the vibration reducing effect. Crane 1 thus maximizes the vibration reducing effect at resonance frequency ω(n) of load W. That is, crane 1 can generate filtered control signal Cd(na2) for prioritizing the vibration reducing effect in the automatic control.

In addition, when emergency stop manipulation by manually manipulating a specific manipulation tool or emergency stop manipulation by a manipulation tool in a specific manipulation procedure is carried out, control device 33 does not apply notch filter F(n) to control signal C(ne) generated based on the emergency stop manipulation of any of the manipulation tools.

For example, when the emergency stop manipulation for bringing all the manipulation tools back to neutral states at once is performed in order to immediately stop swivel base 7 and telescopic boom 9 of crane 1, control device 33 determines that specific manual manipulation is performed and does not apply notch filter F(n) to control signal C(ne) generated based on the emergency stop manipulation of the manipulation tools. Accordingly, keeping the manipulability of the manipulation tools is prioritized in crane 1 and swivel base 7 and telescopic boom 9 are immediately stopped without any delay. That is, crane 1 does not carry out the vibration control in the emergency stop manipulation of the manipulation tools.

Hereinafter, the vibration control of control device 33 based on the operational state of crane 1 will be specifically described with reference to FIGS. 6 to 8. The description will be given on the supposition that at least control signal C(n) according to the manipulation of one manipulation tool, control signal C(n+1) according to the manipulation of another manipulation tool, or control signal C(ne) at the time of emergency manipulation by the emergency stop manipulation of a manipulation tool is generated according to manipulated states of manipulation tools in crane 1.

Control device 33 carries out an application process of applying notch filter F(n1) when the manual control with a single manipulation tool is carried out. Control device 33 generates notch filter F(n1) with predetermined notch depth coefficient δc1 and applies notch filter F(n1) to control signal C(n) when control signal C(n) is generated by manipulating one manipulation tool solely.

Moreover, control device 33 carries out an application process of applying notch filter F(n2) when the manual control with a plurality of manipulation tools is carried out. Control device 33 generates notch filter F(n2) with separately predetermined notch depth coefficient δc2 and applies notch filter F(n2) to control signal C(n) and control signal C(n+1) when control signal C(n+1) is generated by the manipulation of the other manipulation tool in addition to the manipulation of the one manipulation tool.

Control device 33 carries out the application process of applying notch filter F(n2) when the automatic control is carried out. Control device 33 generates notch filter F(n2) with separately predetermined notch depth coefficient δc2 and applies notch filter F(n2) to control signal C(na) when control signal C(na) that is not based on manipulation of any of the manipulation tools is generated by the automatic control.

Control device 33 does not apply notch filter F(n) to control signal C(ne) when the emergency stop manipulation by a manipulation tool in a specific manipulation procedure is performed and control signal C(ne) is generated. That is, control device 33 performs a control task based on generated control signal C(ne).

Figure 6:
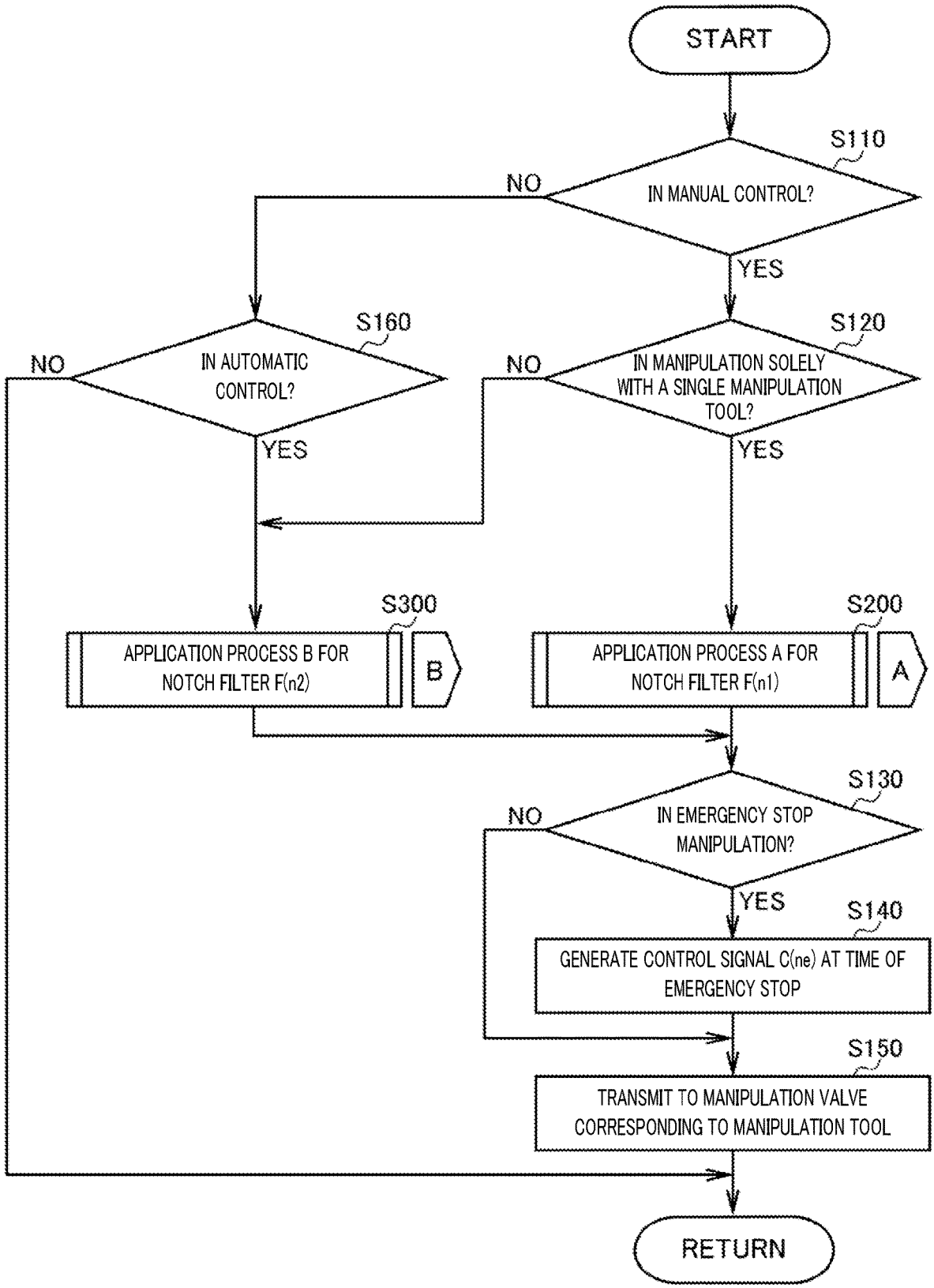
FIG. 6 is a flowchart indicating an entire control mode of a vibration control in Embodiment 1 of the present invention.

As illustrated in FIG. 6, control device 33 determines whether or not the manual control in which a manipulation tool is manipulated is being carried out.

When a result of the determination indicates that the manual control in which the manipulation tool is manipulated is being carried out, control device 33 proceeds to step S120.

On the other hand, when the manual control in which the manipulation tool is manipulated is not being carried out, control device 33 proceeds to step S150.

At step S120, control device 33 determines whether or not a single manipulation tool is being manipulated.

When a result of the determination indicates that the single manipulation tool is being manipulated (that is, when a single actuator is being controlled by manipulation of the single manipulation tool), control device 33 proceeds to step S200.

On the other hand, when the manipulation is not only by the single manipulation tool (that is, when a plurality of actuators are being controlled by manipulation of a plurality of manipulation tools), control device 33 proceeds to step S300.

Figure 7:
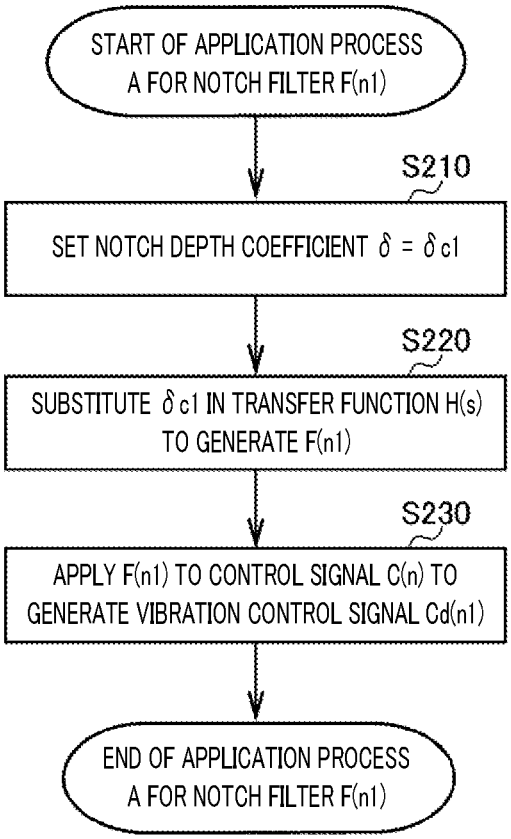
FIG. 7 illustrates a flowchart indicating a notch-filter application process in sole manipulation of one manipulation tool in the vibration control according to Embodiment 1 of the present invention.

Control device 33 starts application process A of applying notch filter F(n1) at step S200, and proceeds to step S210 (see FIG. 7). Then, after application process A of applying notch filter F(n1) is ended, control device 33 proceeds to step S130 (see FIG. 6).

As illustrated in FIG. 6, control device 33 determines at step S130 whether or not the emergency stop manipulation by a manipulation tool in a specific manipulation procedure is being performed.

When a result of the determination indicates that the emergency stop manipulation by the manipulation tool in the specific manipulation procedure is being performed (that is, when control signal C(ne) at the time of the emergency stop manipulation is generated), control device 33 proceeds to step S140.

On the other hand, when the emergency stop manipulation by the manipulation tool in the specific manipulation procedure is not being performed (that is, when control signal C(ne) at the time of the emergency stop manipulation is not generated), control device 33 proceeds to step S110.

Control device 33 generates control signal C(ne) at the time of the emergency manipulation according to the emergency stop manipulation at step S140. That is, control device 33 generates control signal C(ne) to which neither notch filter F(n1) nor notch filter F(n2) is applied, and proceeds to step S150.

Control device 33 transmits the generated filtered control signal to a manipulation valve corresponding to the generated filtered control signal at step S150, and proceeds to step S110. In addition, when control signal C(ne) at the time of the emergency stop manipulation is generated, control device 33 transmits only control signal C(ne) at the time of the emergency stop manipulation to the corresponding manipulation valve, and proceeds to step S110.

Control device 33 determines at step S160 whether or not the automatic control is being carried out.

When a result of the determination indicates that the automatic control is being carried out, control device 33 proceeds to step S300.

On the other hand, when the automatic control is not being carried out (that is, when none of control signal C(n) of the manual control and control signal C(na) of the automatic control are generated), control device 33 proceeds to step S110.

Figure 8:
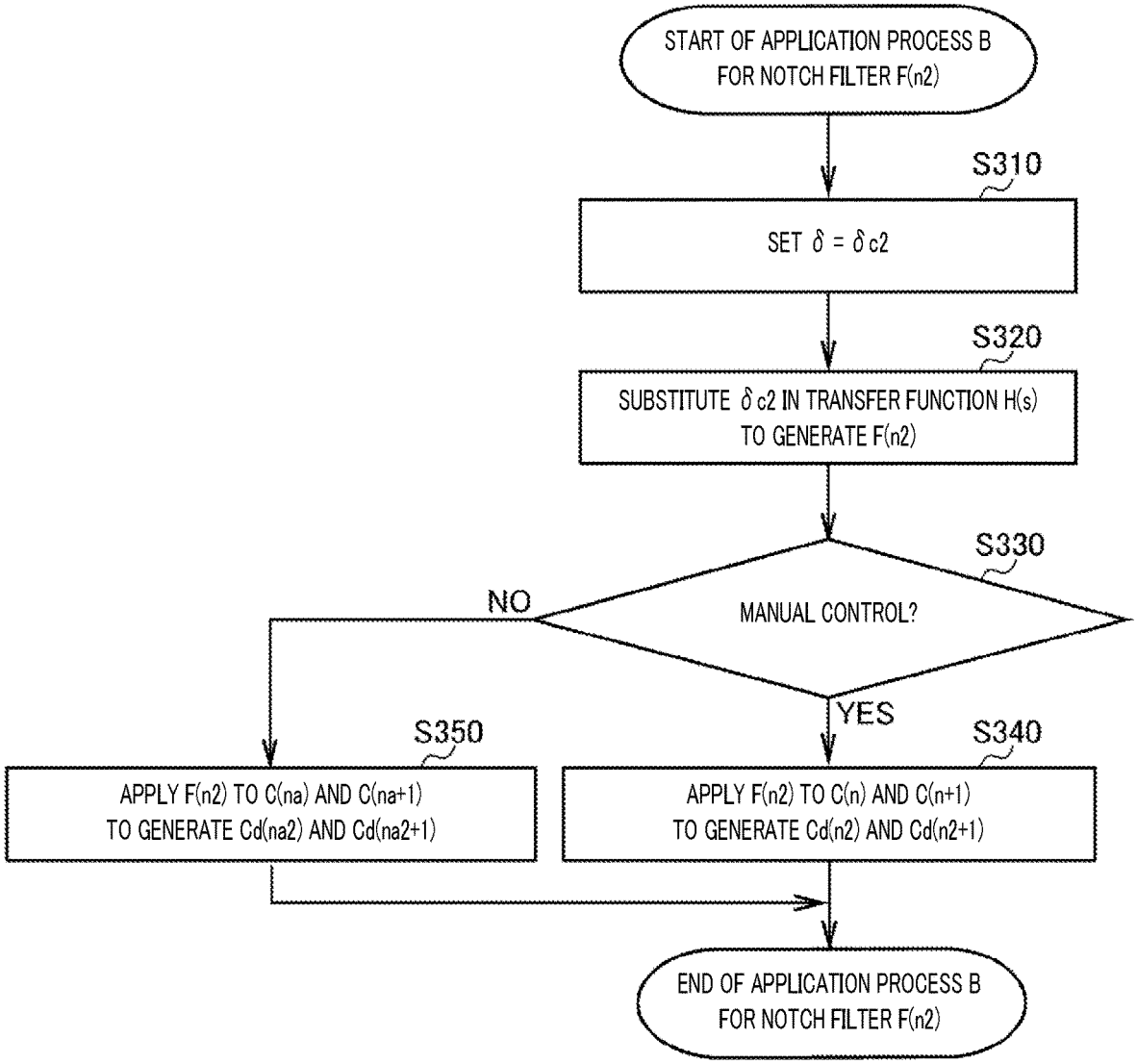
FIG. 8 illustrates a flowchart indicating a notch-filter application process in manipulation of a plurality of manipulation tools in the vibration control according to Embodiment 1 of the present invention.

Control device 33 starts application process B of applying notch filter F(n2) at step S300, and proceeds to step S310 (see FIG. 8). Then, after application process B of applying notch filter F(n2) is ended, control device 33 proceeds to step S130 (see FIG. 6).

As illustrated in FIG. 7, control device 33 sets notch depth coefficient δ to notch depth coefficient δc1 of a predetermined value close to 1 (e.g., notch depth coefficient δc2=0.7) at step S210 of application process A of applying notch filter F(n1), and proceeds to step S220.

Control device 33 applies notch depth coefficient δc1 to transfer function H(s) (see Equation 2) of notch filter F(n) to generate notch filter F(n1) at step S220, and proceeds to step S230.

Control device 33 applies notch filter F(n1) to control signal C(n) to generate filtered control signal Cd(n1) corresponding to control signal C(n) at step S230, ends application process A of applying notch filter F(n1), and proceeds to step S130 (see FIG. 6).

As illustrated in FIG. 8, control device 33 sets notch depth coefficient δ to notch depth coefficient δc2 of a predetermined value close to 0 (e.g., notch depth coefficient δc2=0.0) at step S310 of application process B of applying notch filter F(n2), and proceeds to step S320.

Control device 33 applies notch depth coefficient δc2 to transfer function H(s) (see Equation 2) of notch filter F(n) to generate notch filter F(n2) at step S320, and proceeds to step S330.

Control device 33 determines at step S330 whether or not the manual control is being carried out.

When a result of the determination indicates that the manual control is being carried out, control device 33 proceeds to step S340.

On the other hand, when the manual control is not being carried out, control device 33 proceeds to step S350.

Control device 33 applies notch filter F(n2) to control signal C(n) according to one manipulation tool and control signal C(n+1) according to another manipulation tool to generate filtered control signal Cd(n2) corresponding to control signal C(n) and filtered control signal Cd(n2+1) corresponding to filtered control signal Cd(n2+1) at step S340, ends application process B of applying notch filter F(n2), and proceeds to step S130 (see FIG. 6).

Control device 33 applies notch filter F(n2) to control signal C(na) of the automatic control corresponding to the one manipulation tool and control signal C(na+1) of the automatic control corresponding to the other manipulation tool to generate filtered control signal Cd(na2) corresponding to control signal C(na) and filtered control signal Cd(na2+1) corresponding to filtered control signal Cd(na+1) at step S350, ends application process B of applying notch filter F(n2), and proceeds to step S130 (see FIG. 6).

As described above, crane 1 carries out the vibration control for prioritizing the manipulability when the one manipulation tool is solely manipulated in the manual control, or carries out the vibration control with an enhanced vibration reducing effect when a plurality of manipulation tools are manipulated simultaneously. Moreover, crane 1 carries out the vibration control with an enhanced vibration reducing effect in the automatic control including an automatic stop control, an automatic conveyance control, and/or the like depending on a restriction on a working region. In addition, when the emergency stop signal is generated by manipulation of a manipulation tool, switching to the vibration control for prioritizing the manipulability takes place. That is, crane 1 is configured such that control device 33 selectively switches notch filter F(n) applied to control signal C(n) according to the manipulated state of a manipulation tool. It is thus possible to obtain the manipulability and vibration reducing effect according to the operational state of crane 1.

Note that, notch depth coefficient δ may also be set according to the manipulated state of the manipulation tool in an embodiment other than the present embodiment. Control device 33 is configured to set notch depth coefficient δc3 of any predetermined value of from 0 to 1 according to the variation amount (acceleration) per unit time of control signal C(n) generated based on manipulation of a manipulation tool. Control device 33 is also configured to set notch filter F(na) with notch depth coefficient δca=0.0 which is a predetermined value.

For example, in order that the vibration-control reducing effect is enhanced with increase in variation amount per unit time of control signal C(n), control device 33 sets notch depth coefficient δc3 of a value inversely proportional to the variation amount per unit time of control signal C(n) with reference to notch depth coefficient δ for a predetermined variation amount per predetermined unit time of control signal C(n), and at each time, applies, to control signal C(n), notch filter F(n) for attenuating frequency components centrally including resonance frequency ω(n). Accordingly, the vibration reducing effect at resonance frequency ω(n) of load W is enhanced in proportion to the variation amount per unit time of control signal C(n) in crane 1. That is, crane 1 can generate filtered control signal Cd(n) that gives a higher priority to the vibration reducing effect with increase in variation amount per unit time of control signal C(n) and gives a higher priority to keeping the manipulability with decrease in variation amount per unit time of control signal C(n). It is thus possible to obtain the manipulability and vibration reducing effect according to the operational state of crane 1.

Next, a description will be given of crane 34 that is Embodiment 2 of the crane according to the present invention with reference to FIGS. 2 and 9 to 12. Note that, the same components are provided with the same names, reference numerals, and symbols between crane 1 illustrated in FIGS. 1 to 10 and cranes 34 and 35 according to the following embodiments. In the following embodiments, the detailed descriptions of the same points as in the already described embodiment will be omitted, and differences between the embodiments will be mainly described.

As illustrated in FIG. 2, in control device 33, filter-coefficient computation section 33*d* is connected to swivel encoder 27, boom-length detection sensor 28, weight sensor 29, luffing encoder 30, main fed-out length detection sensor 31, and sub fed-out length detection sensor 32, and can obtain the swivel position of swivel base 7, the boom length, the luffing angle, suspended length Lm(n) of main wire rope 14, suspended length Ls(n) of sub wire rope 16 (see FIG. 1), and weight Wt of load W.

Accordingly, control device 33 can compute position P (see FIG. 9) of load W in working region R0 of crane 34 from the swivel position of swivel base 7, the boom length, the luffing angle, suspended length Lm(n) of main wire rope 14, and suspended length Ls(n) of sub wire rope 16 obtained by filter-coefficient computation section 33*d*.

A vibration control based on the operational state of crane 34 will be described with reference to FIGS. 9 to 11. In the present embodiment, control device 33 sets notch depth coefficient δ of notch filter F(n) based on position P of load W representing the operational state of crane 34. Although notch width coefficient ζ of notch filter F(n) is set to a predetermined fixed value, notch width coefficient ζ may also be set based on the operational state of crane 34.

Figure 9:
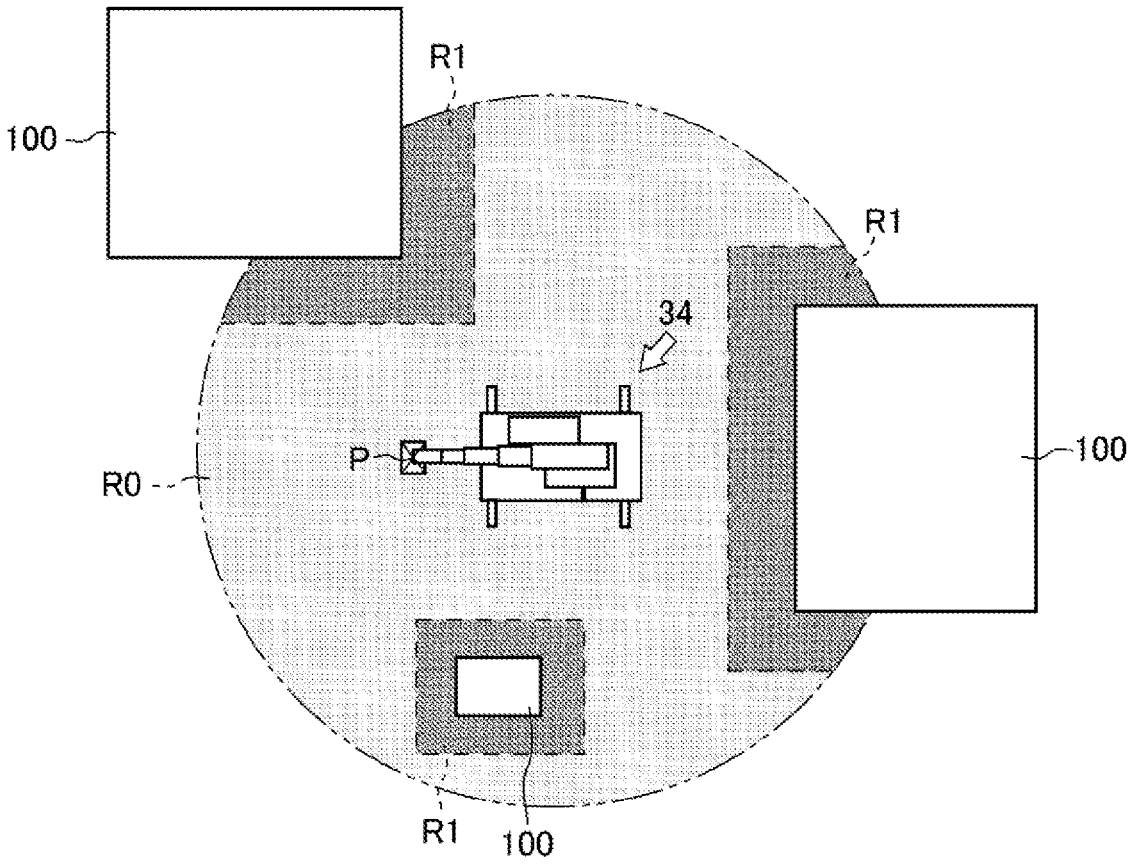
FIG. 9 schematically illustrates a working region and vibration reduction regions of a crane in Embodiment 2 of the present invention.

As illustrated in FIG. 9, in the vibration control, filter-coefficient computation section 33*d* of control device 33 obtains, from control-signal generation section 33*a*, computed control signal C(n) generated based on computed manipulation of a manipulation tool (see FIG. 2), and computes position P of load W in working region R0 of crane 34. Further, filter-coefficient computation section 33*d* of control device 33 sets notch filter F(n4) with notch depth coefficient δc4 of any value predetermined according to position P of load W.

For example, when regions where it is desired to prioritize the vibration reducing effect because of planimetric features 100 disposed in working region R0 or the like (hereinafter, such regions are simply referred to as "vibration reduction regions R1") are set, control device 33 sets notch depth coefficient δc4 of a value close to 0 in vibration reduction regions R1 (e.g., notch depth coefficient δc4=0.3), and generates notch filter F(n4) with an increased attenuation rate of frequency components centrally including resonance frequency ω(n). On the other hand, in regions other than vibration reduction regions R1, control device 33 sets notch depth coefficient δc5 of a value closer to 1 than notch depth coefficient δc4 is (e.g., notch depth coefficient δc5=0.7), and generates notch filter F(n5) with a reduced attenuation rate of frequency components centrally including resonance frequency ω(n).

When control device 33 determines that position P of load W computed by filter-coefficient computation section 33*d* for each scan time is included in vibration reduction regions R1, control device 33 applies notch filter F(n4) to control signal C(n). Crane 34 can thus enhance the vibration reducing effect at resonance frequency ω(n) of load W in vibration reduction regions R1. When control device 33 determines that position P of load W computed by filter-coefficient computation section 33*d* for each scan time is not included in vibration reduction regions R1, control device 33 applies notch filter F(n5) to control signal C(n). Thus, crane 34 prioritizes keeping the manipulability of the manipulation tool over the vibration reducing effect at resonance frequency ω(n) of load W in the regions other than vibration reduction regions R1. That is, crane 34 can generate filtered control signal Cd(n4) or filtered control signal Cd(n5) by notch filter F(n4) or notch filter F(n5) with frequency characteristics according to the situation of planimetric features 100 in working region R0. Note that, although vibration reduction regions R1 are set based on disposed planimetric features 100 in the present embodiment, vibration reduction regions R1 are not limited to this embodiment and may also be set based on the attitude of working crane 34 or the like.

Hereinafter, the vibration control of control device 33 based on the operational state of crane 34 will be specifically described with reference to FIGS. 10 to 11. The description will be given on the supposition that vibration reduction regions R1 are predetermined in working region R0 of crane 34. The description will be given also on the supposition that any of swivel manipulation tool 18, luffing manipulation tool 19, main-drum manipulation tool 21, and sub-drum manipulation tool 22 is manipulated, and control signal C(n) that is a speed command for the manipulation tool is generated by control device 33 in crane 34.

When control signal C(n) is generated by manipulation of any of the manipulation tools in an application process of applying notch filter F(n) for each working region in the vibration control, control device 33 sets notch filter F(n4) or notch filter F(n5) with notch depth coefficient δc4 or notch depth coefficient δc5 predetermined according to position P of load W in working region R0, and applies notch filter F(n4) or notch filter F(n5) to control signal C(n).

Figure 10:
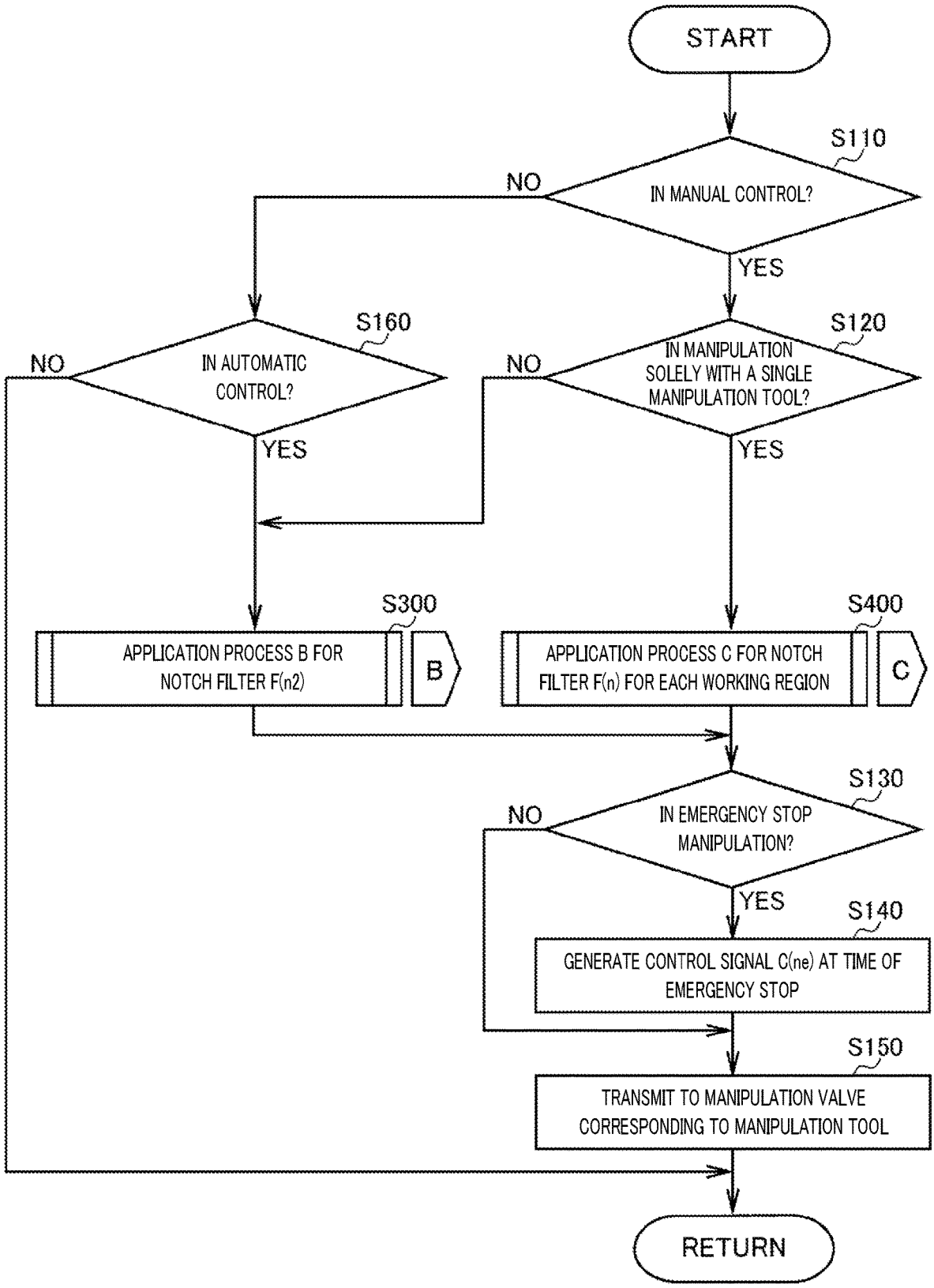
FIG. 10 is a flowchart indicating an entire control mode of a vibration control according to Embodiment 2 of the present invention.
Figure 11:
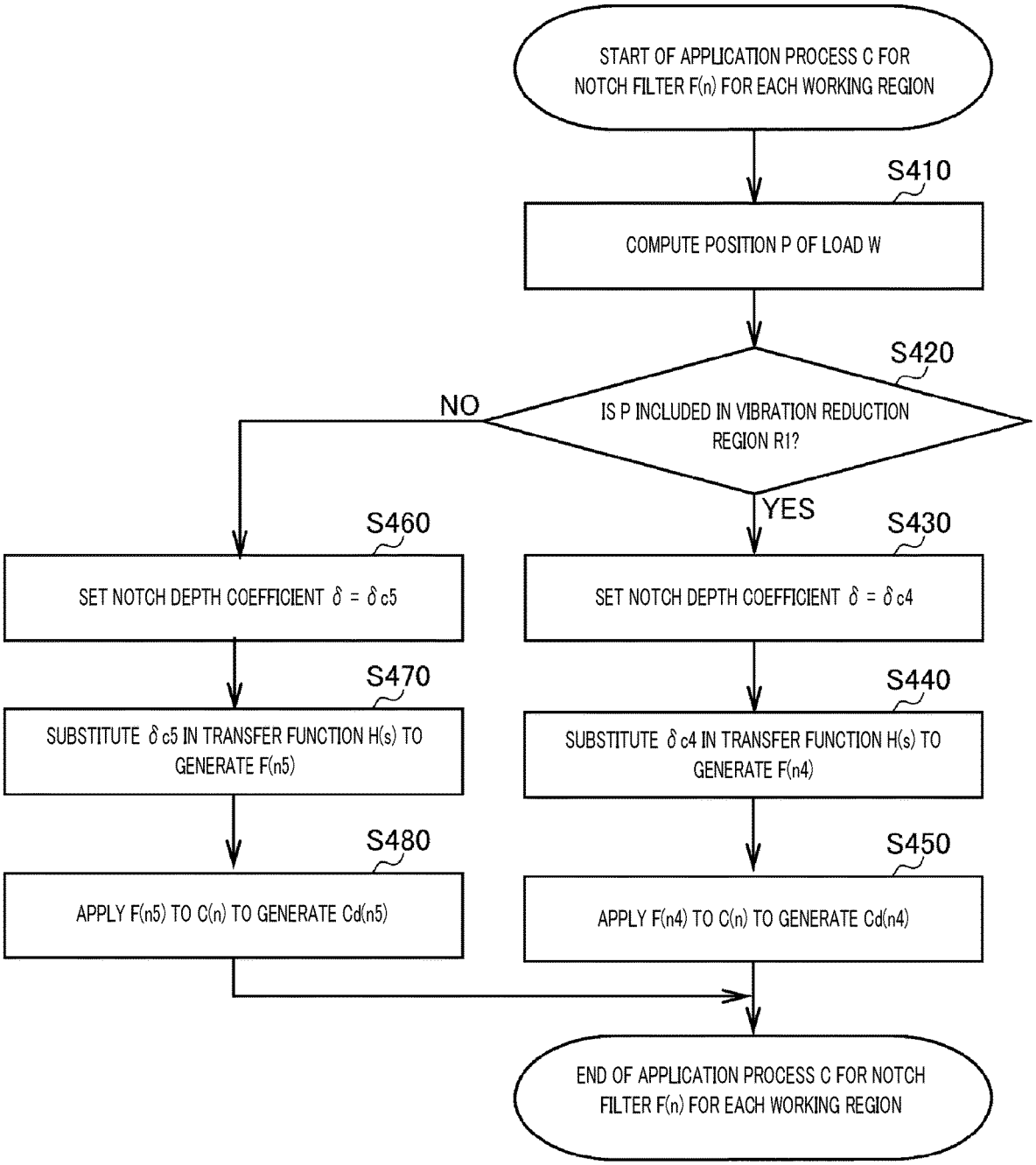
FIG. 11 illustrates a flowchart indicating a notch-filter application process for each working region in the vibration control according to Embodiment 2 of the present invention.

As illustrated in FIG. 10, control device 33 starts application process C of applying notch filter F(n) for each working region at step S400 of the vibration control, and proceeds to step S410 (see FIG. 11). Then, after application process C of applying notch filter F(n) for each working region is ended, control device 33 proceeds to step S130 (see FIG. 10).

As illustrated in FIG. 11, control device 33 starts application process C of applying notch filter F(n) for each working region to compute position P of load W in working region R0 of crane 34 from the swivel position of swivel base 7, the boom length and luffing angle of telescopic boom 9, and suspended length Lm(n) of main wire rope 14 or suspended length Ls(n) of sub wire rope 16 at step S410, and proceeds to step S420.

Control device 33 determines at step S420 whether or not position P of load W obtained is included in vibration reduction regions R1.

When a result of the determination indicates that position P of load W obtained is included in vibration reduction regions R1, control device 33 proceeds to step S430.

On the other hand, when the result of the determination indicates that position P of load W obtained is not included in vibration reduction regions R1, control device 33 proceeds to step S460.

Control device 33 sets notch depth coefficient δ to predetermined notch depth coefficient δc4 at step S430, and proceeds to step S440.

Control device 33 applies notch depth coefficient δc4 to transfer function H(s) (see Equation 2) of the notch filter to generate notch filter F(n4) at step S440, and proceeds to step S450.

Control device 33 applies notch filter F(n4) to control signal C(n) to generate filtered control signal Cd(n4) at step S450, ends application process C of applying notch filter F(n) for each working region, and proceeds to step S130 (see FIG. 10).

Control device 33 sets notch depth coefficient δ to predetermined notch depth coefficient δc5 at step S460, and proceeds to step S470.

Control device 33 applies notch depth coefficient δc5 to transfer function H(s) (see Equation 2) of the notch filter to generate notch filter F(n5) at step S470, and proceeds to step S480.

Control device 33 applies notch filter F(n5) to control signal C(n) to generate filtered control signal Cd(n5) at step S480, ends application process C of applying notch filter F(n) for each working region, and proceeds to step S130 (see FIG. 10).

Thus, when vibration reduction regions R1 are set in working region R0 of crane 34, notch depth Dn of notch filter F(n4) for vibration reduction regions R1 is set to a value greater than notch depth Dn of notch filter F(n5) for working region R0 other than vibration reduction regions R1. That is, the vibration control for enhancing the vibration reducing effect is carried out in crane 34 when load W passes through or is disposed in vibration reduction regions R1 where it is desired to reduce a vibration because of planimetric features 100 disposed, the attitude of working crane 34, and/or the like. Moreover, the vibration control for prioritizing the manipulability is carried out in crane 34 when load W passes through or is disposed in a region where it is unnecessary to reduce a vibration. It is thus possible to obtain the manipulability and vibration reducing effect according to the operational state of crane 34 (see FIG. 11).

Next, a description will be given of crane 35 that is Embodiment 3 of the crane according to the present invention with reference to FIGS. 2, 12, and 13.

As illustrated in FIG. 2, filter-coefficient computation section 33*d* of control device 33 is connected to weight sensor 29 and can obtain weight Wt of load W.

A vibration control based on the operational state of crane 35 will be described with reference to FIGS. 12 and 13. In the present embodiment, control device 33 sets notch depth coefficient δ of notch filter F(n) based on weight Wt of load W representing the operational state of crane 35. Although notch width coefficient ζ of notch filter F(n) is set to a predetermined fixed value, notch width coefficient ζ may also be set based on the operational state of crane 35.

In the vibration control, filter-coefficient computation section 33*d* of control device 33 obtains, from control-signal generation section 33*a*, control signal C(n) generated based on computed manipulation of any of the manipulation tools and obtains weight Wt of load W. Further, when control signal C(n) is generated, filter-coefficient computation section 33*d* of control device 33 sets notch filter F(n6) with notch depth coefficient δc6 according to weight Wt of load W and applies notch filter F(n6) to control signal C(n).

For example, in order that the vibration reducing effect is enhanced with increase in weight Wt of load W, control device 33 sets notch depth coefficient δc6 of a value inversely proportional to weight Wt of load W with reference to notch depth coefficient δ for predetermined weight Wt of load W, and at each time, applies, to control signal C(n), notch filter F(n6) for attenuating frequency components centrally including resonance frequency ω(n). It is thus possible to enhance the vibration reducing effect with increase in weight Wt of load Win crane 35. That is, crane 35 can generate filtered control signal Cd(n) by notch filter F(n6) with the frequency characteristics according to weight Wt of load W.

Hereinafter, the vibration control of control device 33 based on the operational state of crane 35 will be specifically described with reference to FIGS. 12 and 13. The description will be given on the supposition that any of swivel manipulation tool 18, luffing manipulation tool 19, main-drum manipulation tool 21, and sub-drum manipulation tool 22 is manipulated, and control signal C(n) that is a speed command for any of the manipulation tools is generated by control device 33 in crane 35.

When the variation amount per unit time of control signal C(n) generated by manipulation of any of the manipulation tools is greater than threshold th in an application process of applying notch filter F(n) according to weight Wt of load W in the vibration control, control device 33 sets notch filter F(n6) with notch depth coefficient δc6 according to weight Wt of load W and applies notch filter F(n6) to control signal C(n).

Figure 12:
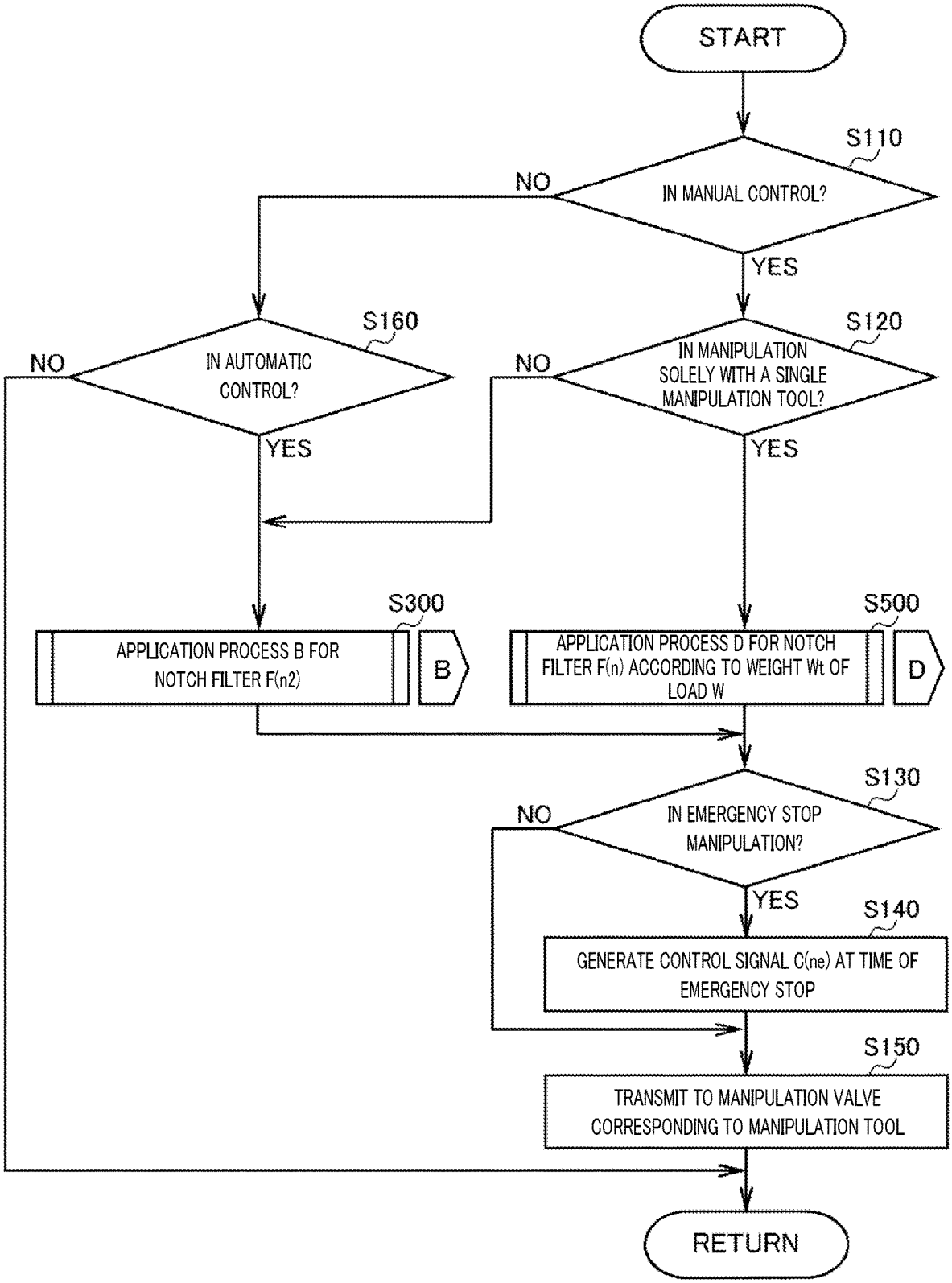
FIG. 12 is a flowchart indicating an entire control mode of a vibration control according to Embodiment 3 of the present invention.
Figure 13:
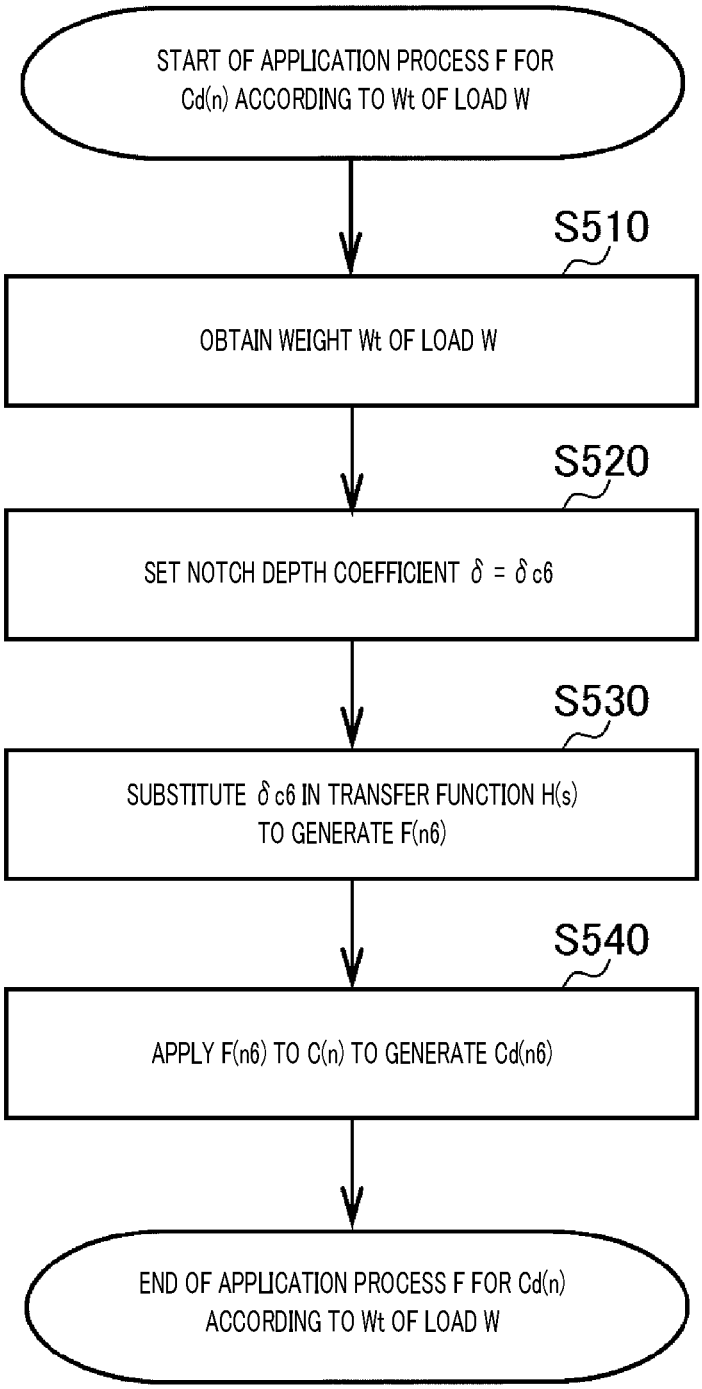
FIG. 13 illustrates a flowchart indicating a notch-filter application process according to the weight of a load in the vibration control according to Embodiment 3 of the present invention.

As illustrated in FIG. 12, control device 33 starts application process D of applying notch filter F(n) according to weight Wt of load W at step S500 of the vibration control, and proceeds to step S510 (see FIG. 13). Then, after application process D of applying notch filter F(n) according to weight Wt of load W is ended, control device 33 proceeds to step S130 (see FIG. 12).

As illustrated in FIG. 13, control device 33 starts application process D of applying notch filter F(n) according to weight Wt of load W at step S510, obtains weight Wt of load W, and proceeds to step S520.

Control device 33 sets notch depth coefficient δ to notch depth coefficient δc6 according to weight Wt of load W at step S520, and proceeds to step S530.

Control device 33 applies notch depth coefficient δc6 to transfer function H(s) (see Equation 2) of notch filter F(n) to generate notch filter F(n6) at step S530, and proceeds to step S540.

Control device 33 applies notch filter F(n6) to control signal C(n) to generate filtered control signal Cd(n6) at step S540, ends application process D of applying notch filter F(n) according to weight Wt of load W, and proceeds to step S130 (see FIG. 12).

As described above, when notch depth Dn is defined according to weight Wt of load W, greater notch depth Dn of notch filter F(n6) is set for weight Wt for which a shake is not easily settled due to the effect of moment of inertia. That is, based on weight Wt of load W, the vibration control with an enhanced vibration reducing effect is carried out in crane 35 for load W for which its shake is not easily settled, or the vibration control for prioritizing the manipulability is carried out in crane 35 for load W for which its shake is comparatively easily settled. It is thus possible to obtain the manipulability and vibration reducing effect according to the operational state of crane 35.

In the vibration control according to the present invention, a resultant frequency resulting from combination of the natural vibration frequency excited when each of the structural components constituting crane 1, 34, or 35 is vibrated by an external force and resonance frequency ω(n) is used as referential center frequency ωc(n) of notch filter F(n1) and notch filter F(n2) applied to control signal C(n) in Embodiment 1, notch filter F(n) for each working region applied to control signal C(n) in Embodiment 2, or notch filter F(n) according to weight Wt of load W applied to control signal C(n) in Embodiment 3, so that it is possible to reduce together not only a vibration at resonance frequency ω(n) but also a vibration at the natural vibration frequency that each of the structural components of crane 1, 34, or 35 has. Here, the natural vibration frequency excited when each of the structural components constituting crane 1, 34, or 35 is vibrated by an external force means a natural frequency, such as the natural frequency of telescopic boom 9 in the luffing direction or in the swiveling direction, the natural frequency of telescopic boom 9 due to its axial distortion, the resonance frequency of the double pendulum composed of main hook block 10 or sub hook block 11 and a slinging wire rope, the natural frequency during stretching vibration caused by stretch of main wire rope 14 or sub wire rope 16, or the like.

Note that, although application process A of applying notch filter F(n1) and application process B of applying notch filter F(n2) of one manipulation tool in Embodiment 1, application process C of applying notch filter F(n) for each working region in Embodiment 2, and application process D of applying notch filter F(n) according to weight Wt of load W in Embodiment 3 are carried out separately from one another in the vibration control according to the present invention, a vibration control in which these application processes are carried out together in a single embodiment is possible. Note also that, although resonance frequency ω(n) of control signal C(n) is attenuated by notch filter F(n) in cranes 1, 34, and 35 in the vibration control according to the present invention, attenuation may also be done by a filter such as a low pass filter, a high pass filter, a band stop filter, or the like.

The embodiment described above showed only a typical form, and can be variously modified and carried out within the range without deviation from the main point of one embodiment. Further, it is needless to say that the present invention can be carried out in various forms, and the scope of the present invention is indicated by the descriptions of the claims, and includes the equivalent meanings of the descriptions of the claims and every change within the scope.

INDUSTRIAL APPLICABILITY

The present invention is applicable to a remote manipulation terminal and a work vehicle provided with a remote manipulation terminal.

REFERENCE SIGNS LIST

1 Crane
8 Hydraulic swivel motor
12 Hydraulic luffing cylinder
14 Main wire rope
16 Sub wire rope
18 Swivel manipulation tool
19 Luffing manipulation tool
33 Control device
Lm(n) Suspended amount of main wire rope
Ls(n) Suspended amount of sub wire rope
ω(n) Resonance frequency
C(n) Control signal
Cd(n) Filtered control signal

The invention claimed is:

1. A crane comprising:

a control device that controls an actuator by computing a resonance frequency of a shake of a load, generating a control signal for the actuator according to manipulation of a manipulation tool, and generating a filtered control signal for the actuator, the resonance frequency being determined by a suspended length of a wire rope, the filtered control signal being the control signal from which a frequency component in any frequency range is attenuated at any rate with reference to the resonance frequency, wherein the control device sets differently between a manual-control case and an automatic-control case on at least one of the frequency range of the frequency component to be attenuated and the rate at which the frequency component is attenuated, the manual-control case being where the actuator is controlled by manipulation of the manipulation tool, the automatic-control case being where the actuator is controlled without the manipulation of the manipulation tool.

2. A crane comprising:

a control device that controls an actuator by computing a resultant frequency resulting from combination of a resonance frequency of a shake of a load and a natural vibration frequency excited when a structural component constituting the crane is vibrated by an external force, generating a control signal for the actuator according to manipulation of a manipulation tool, and generating a filtered control signal for the actuator, the resonance frequency being determined by a suspended length of a wire rope, the filtered control signal being the control signal from which a frequency component in any frequency range is attenuated at any rate with reference to the resultant frequency, wherein the control device sets differently between a manual-control case and an automatic-control case on at least one of the frequency range of the frequency component to be attenuated and the rate at which the frequency component is attenuated, the manual-control case being where the actuator is controlled by manipulation of the manipulation tool, the automatic-control case being where the actuator is controlled without the manipulation of the manipulation tool.

3. The crane according to claim 1, wherein the control device sets at least one of the frequency range of the frequency component to be attenuated and the rate at which the frequency component is attenuated based on an operational state of the crane in the manual-control case where the actuator is controlled by the manipulation of the manipulation tool, and switches at least one of the frequency range of the frequency component to be attenuated and the rate at which the frequency component is attenuated to a predetermined value in the automatic-control case where the actuator is controlled without the manipulation of the manipulation tool.

4. The crane according to claim 1, wherein the control device sets differently between a first manual-control case and a second manual-control case on at least one of the frequency range of the frequency component to be attenuated and the rate at which the frequency component is attenuated, the first manual-control case being where the actuator being a single actuator is controlled by the manipulation of the manipulation tool, the second manual-control case being where a plurality of the actuators are controlled by the manipulation of the manipulation tool.

5. The crane according to claim 1, wherein the control device switches, when an emergency stop signal is generated by the manipulation of the manipulation tool, control for the actuator by the filtered control signal from which the frequency component in any frequency range is attenuated at any rate into control by the control signal from which the frequency component is not attenuated.

6. The crane according to claim 1, wherein the control device switches at least one of the frequency range of the frequency component to be attenuated and the rate at which the frequency component is attenuated according to a position of the load in a working region of the crane.

7. The crane according to claim 1, wherein the control device sets at least one of the frequency range of the frequency component to be attenuated and the rate at which the frequency component is attenuated according to a weight of the load.

8. The crane according to claim 2, wherein the control device sets at least one of the frequency range of the frequency component to be attenuated and the rate at which the frequency component is attenuated based on an operational state of the crane in the manual-control case where the actuator is controlled by the manipulation of the manipulation tool, and switches at least one of the frequency range of the frequency component to be attenuated and the rate at which the frequency component is attenuated to a predetermined value in the automatic-control case where the actuator is controlled without the manipulation of the manipulation tool.

9. The crane according to claim 2, wherein the control device sets differently between a first manual-control case and a second manual-control case on at least one of the frequency range of the frequency component to be attenuated and the rate at which the frequency component is attenuated, the first manual-control case being where the actuator being a single actuator is controlled by the manipulation of the manipulation tool, the second manual-control case being where a plurality of the actuators are controlled by the manipulation of the manipulation tool.

10. The crane according to claim 2, wherein the control device switches, when an emergency stop signal is generated by the manipulation of the manipulation tool, control for the actuator by the filtered control signal from which the frequency component in any frequency range is attenuated at any rate into control by the control signal from which the frequency component is not attenuated.

11. The crane according to claim 2, wherein the control device switches at least one of the frequency range of the frequency component to be attenuated and the rate at which the frequency component is attenuated according to a position of the load in a working region of the crane.

12. The crane according to claim 2, wherein the control device sets at least one of the frequency range of the frequency component to be attenuated and the rate at which the frequency component is attenuated according to a weight of the load.

* * * * *